US012790934B1

(12) United States Patent
Gillan

(10) Patent No.: US 12,790,934 B1
(45) Date of Patent: Nov. 10, 2026

(54) SYSTEMS AND METHODS FOR CALCULATING TWIST IN A DRILL STRING

(71) Applicant: NABORS DRILLING TECHNOLOGIES USA, INC., Houston, TX (US)

(72) Inventor: Colin Gillan, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 19/227,099

(22) Filed: Jun. 3, 2025

(51) Int. Cl.
*E21B 44/04* (2006.01)
*E21B 7/06* (2006.01)
*E21B 47/12* (2012.01)

(52) U.S. Cl.
CPC ..... *E21B 44/04* (2013.01); *E21B 7/06* (2013.01); *E21B 47/12* (2013.01)

(58) Field of Classification Search
CPC ..... E21B 44/04; E21B 7/06
See application file for complete search history.

(56) References Cited

U.S. PATENT DOCUMENTS

| | | | | |
|---|---|---|---|---|
| 9,784,035 | B2 | 10/2017 | Boone et al. | |
| 10,094,209 | B2 | 10/2018 | Gillan et al. | |
| 10,851,640 | B2 | 12/2020 | Gillan | |
| 11,236,601 | B2 | 2/2022 | Groover et al. | |
| 2007/0256863 | A1* | 11/2007 | Hulick | E21B 7/046 166/177.6 |
| 2019/0048707 | A1* | 2/2019 | Benson | E21B 7/04 |
| 2019/0301273 | A1* | 10/2019 | Gillan | E21B 44/04 |
| 2023/0184082 | A1* | 6/2023 | Madhireddy | E21B 3/02 175/24 |

* cited by examiner

*Primary Examiner* — Giovanna Wright
(74) *Attorney, Agent, or Firm* — Haynes and Boone, LLP

(57) ABSTRACT

Systems, apparatuses, and methods for calculating twist stored in a drill string during rotary drilling to determine a target oscillation amount for oscillating the drill string during slide drilling. Rotary drilling a wellbore using a top drive imparts a rotational displacement on, and stored in, the drill string. After stopping the rotary drilling, the rotational displacement stored in the drill string is released such that a free reverse rotation is experienced by the top drive as the drill string untwists. A sensor associated with the top drive collects data associated with the free reverse rotation of the drill string. Using the data, the rotational displacement stored in the drill string is calculated, and based on the calculated rotational displacement, a target oscillation amount is determined. During slide drilling, the top drive oscillates the drill string based on the oscillation amount to reduce friction in the wellbore without changing direction.

22 Claims, 8 Drawing Sheets

SYSTEMS AND METHODS FOR CALCULATING TWIST IN A DRILL STRING

TECHNICAL FIELD

The present disclosure is directed to systems and methods for calculating an amount of twist in a drill string, and more specifically, to systems and methods for calculating a rotational displacement introduced into a drill string during rotary drilling and using the calculated rotational displacement to determine an oscillation revolution amount to reduce friction of the drill string in a wellbore during slide drilling.

BACKGROUND

Underground drilling involves drilling a bore through a formation deep in the Earth using a drill bit connected to a drill string. Two common drilling methods, often used within the same hole, include rotary drilling and slide drilling. Rotary drilling typically includes rotating the drill string, including the drill bit at the end of the drill string, and driving it forward through subterranean formations. This rotation often occurs via a top drive or other rotary drive means at the surface, and as such, the entire drill string rotates to drive the bit. This is often used during straight runs, where the objective is to advance the bit in a substantially straight direction through the formation.

Slide drilling is often used to steer the drill bit to effect a turn in the drilling path. For example, slide drilling may employ a drilling motor with a bent housing incorporated into the bottom-hole assembly (BHA) of the drill string. The top side of the bent housing is commonly referred to as the "high side." A directional driller may attempt to steer the wellbore by pointing the high side of the bent motor in a predetermined direction, and holding that direction as consistently as possible. During typical slide drilling, the drill string is not rotated and the drill bit is rotated exclusively by the drilling motor. The bent housing steers the drill bit in the desired direction as the drill string slides through the bore, thereby effectuating directional drilling.

Although the drill string is not rotated during slide drilling, to reduce wellbore friction during slide drilling, the top drive may be used to oscillate or rotationally rock the drill string during slide drilling to reduce drag of the drill string in the wellbore. This oscillation can reduce friction in the borehole. However, too much oscillation can disrupt the direction of the drill bit, sending it off-course during the slide drilling process, and too little oscillation can minimize the benefits of the friction reduction, resulting in low weight-on-bit and overly slow and inefficient slide drilling.

During rotary drilling, an amount of torque imparted into the steel drill string is used to overcome bore friction and drag in the wellbore. This amount of torque, sometimes referred to as "trapped torque," exists between the surface drive equipment, such as a top drive, and the drill bit. This trapped torque is the result of a lag between rotation at the surface and rotation at the drill bit, sometime referred to as "rotational displacement". For long drill strings, the drill bit rotation may lag the surface rotation of the drill string by many revolutions, resulting in a substantial amount of trapped torque.

Some systems and methods utilize rotational torque imparted on the drill string by the top drive during startup of the rotary drilling process to calculate such rotational displacement or trapped torque stored in the drill string. These systems then utilize the calculated rotational displacement to reverse rotation of the drill string between rotary drilling and slide drilling processes to remove the trapped torque in the drill string, however, such conventional systems are not accurate for various reasons.

What is needed is a system and method for determining an oscillation rotation amount for a drill string that is based on a rotational displacement calculated by directly measuring the behavior of the drill string. The present disclosure addresses one or more shortcomings of the prior art.

DETAILED DESCRIPTION

Figure 1:
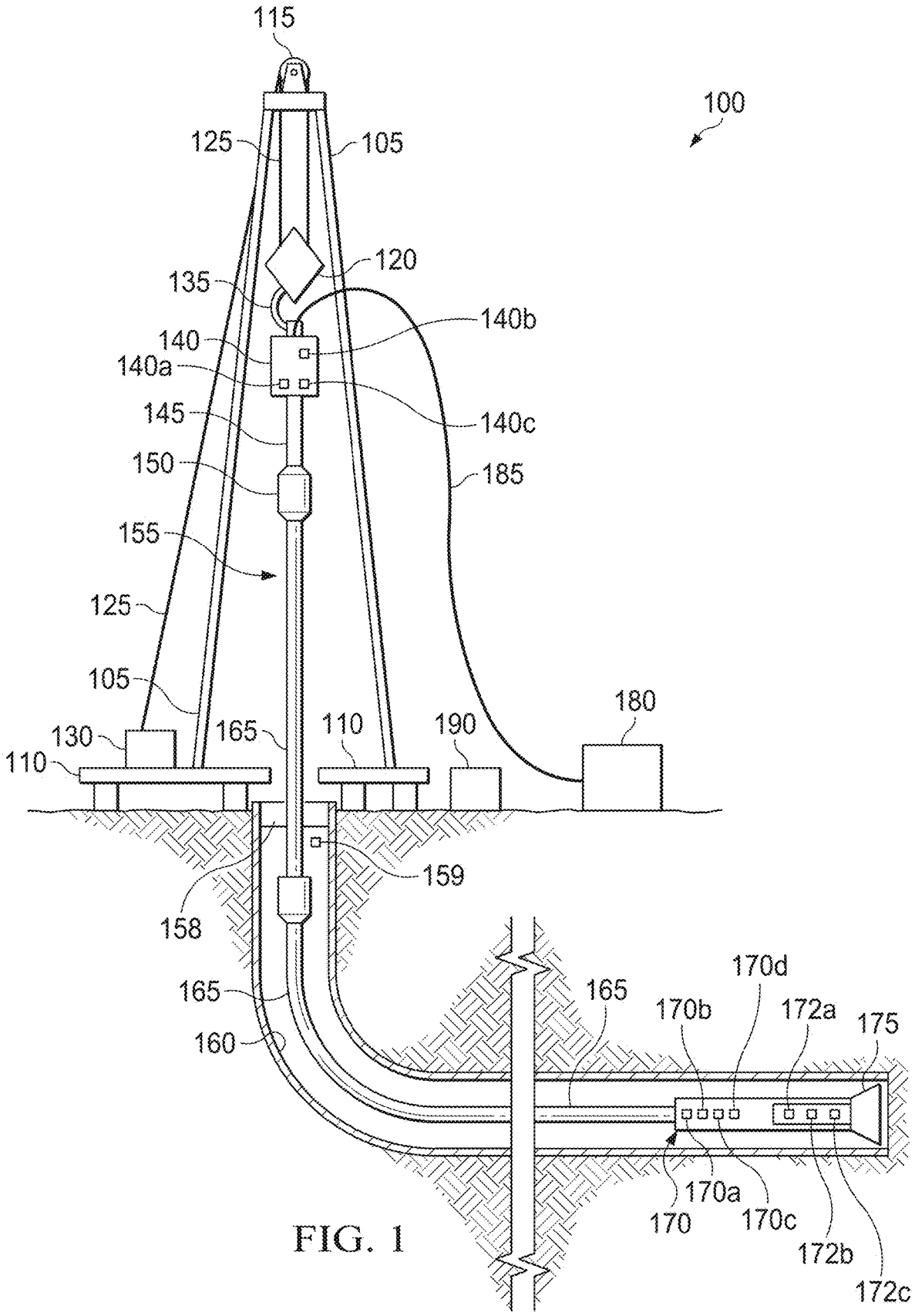
FIG. 1 illustrates an exemplary drilling apparatus, according to one or more embodiments of the present disclosure.

It is to be understood that the following disclosure provides many different implementations, or examples, for implementing different features of various implementations. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed.

FIG. 1 illustrates a schematic view of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel in and out the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig. In addition to the advantages described above, the systems and methods herein may reduce wear and tear on hoisting equipment, decreasing overall rig operating costs.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly. The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a bottom hole assembly (BHA) 170, and a drill bit 175. The BHA 170 may include stabilizers, drill collars, and/or measurement-while-drilling (MWD) or wireline conveyed instruments, among other components. For the purpose of slide drilling the drill string may include a down hole motor with a bent housing or other bend component, operable to create an off-center departure of the bit from the center line of the wellbore. The direction of this departure in a plane normal to the wellbore is referred to as the toolface angle or toolface. The drill bit 175, which may also be referred to herein as a "tool," or a "toolface," may be connected to the bottom of the BHA 170 or otherwise attached to the drill string 155. One or more pumps 180 may deliver drilling fluid to the drill string 155 through a hose or other conduit, which may be connected to the top drive 140. In some implementations, the one or more pumps 180 include a mud pump.

The down hole MWD or wireline conveyed instruments may be configured for the evaluation of physical properties such as pressure, temperature, gamma radiation count, torque, weight-on-bit (WOB), vibration, inclination, azimuth, toolface orientation in three-dimensional space, and/or other down hole parameters. These measurements may be made down hole, stored in memory, such as solid-state memory, for some period of time, and downloaded from the instrument(s) when at the surface and/or transmitted in real-time or delayed time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, transmission as electromagnetic pulses, among other methods. The MWD sensors or detectors and/or other portions of the BHA 170 may have the ability to store measurements for later retrieval via wireline and/or when the BHA 170 is tripped out of the wellbore 160.

In an exemplary implementation, the apparatus 100 may also include a rotating blow-out preventer (BOP) 158 that may assist when the wellbore 160 is being drilled utilizing under-balanced or managed-pressure drilling methods. The apparatus 100 may also include a surface casing annular pressure sensor 159 configured to detect the pressure in an annulus defined between, for example, the wellbore 160 (or casing therein) and the drill string 155.

In the exemplary implementation depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a down hole motor, and/or a conventional rotary rig, among others.

The apparatus 100 also includes a controller 190. The controller 190 may include at least a processor, a memory, and a communication device. The memory may include a cache memory (e.g., a cache memory of the processor), random access memory (RAM), magnetoresistive RAM (MRAM), read-only memory (ROM), programmable read-only memory (PROM), erasable programmable read only memory (EPROM), electrically erasable programmable read only memory (EEPROM), flash memory, solid state memory device, hard disk drives, other forms of volatile and non-volatile memory, or a combination of different types of memory. In some embodiments, the memory may include a non-transitory computer-readable medium. The memory may store instructions. The instructions may include instructions that, when executed by the processor, cause the processor to perform operations described herein with reference to the controller 190 in connection with embodiments of the present disclosure. The terms "instructions" and "code" may include any type of computer-readable statement(s). For example, the terms "instructions" and "code" may refer to one or more programs, routines, sub-routines, functions, procedures, etc. "Instructions" and "code" may include a single computer-readable statement or many computer-readable statements.

The processor of the controller 190 may have various features as a specific-type processor. For example, these may include a central processing unit (CPU), a digital signal processor (DSP), an application-specific integrated circuit (ASIC), a controller, a field programmable gate array (FPGA) device, another hardware device, a firmware device, or any combination thereof configured to perform the operations described herein with reference to the controller 190 as shown in FIG. 1 above. The processor may also be implemented as a combination of computing devices, e.g., a combination of a DSP and a microprocessor, a plurality of microprocessors, one or more microprocessors in conjunction with a DSP core, or any other such configuration.

The communication device of the controller 190 may allow the controller 190 to send and receive signals, instructions, and code from other components of the drilling rig. The controller 190 may be configured to control or assist in the control of one or more components of the apparatus 100. For example, the controller 190 may be configured to transmit operational control signals to the drawworks 130, the top drive 140, the BHA 170 and/or the one or more pumps 180. In some implementations, the controller 190 may be a stand-alone component. The controller 190 may be disposed in any location on the apparatus 100. Depending on the implementation, the controller 190 may be installed near the mast 105 and/or other components of the apparatus 100. In an exemplary implementation, the controller 190 includes one or more systems located in a control room in communication with the apparatus 100, such as the general purpose shelter often referred to as the "doghouse" serving as a combination tool shed, office, communications center, and general meeting place. In other implementations, the controller 190 is disposed remotely from the drilling rig. The controller 190 may be configured to transmit the operational control signals to the drawworks 130, the top drive 140, the BHA 170, and/or the one or more pumps 180 via wired or wireless transmission devices which, for the sake of clarity, are not depicted in FIG. 1.

The controller 190 is also configured to receive electronic signals via wired or wireless transmission devices (also not shown in FIG. 1) from a variety of sensors included in the apparatus 100, where each sensor is configured to detect an operational characteristic or parameter. Depending on the implementation, the apparatus 100 may include a down hole annular pressure sensor 170*a* coupled to or otherwise associated with the BHA 170. The down hole annular pressure sensor 170*a* may be configured to detect a pressure value or range in an annulus shaped region defined between the external surface of the BHA 170 and the internal diameter of the wellbore 160, which may also be referred to as the casing pressure, down hole casing pressure, MWD casing pressure, or down hole annular pressure. Measurements from the down hole annular pressure sensor 170*a* may include both static annular pressure (pumps off) and active annular pressure (pumps on).

Figure 2:
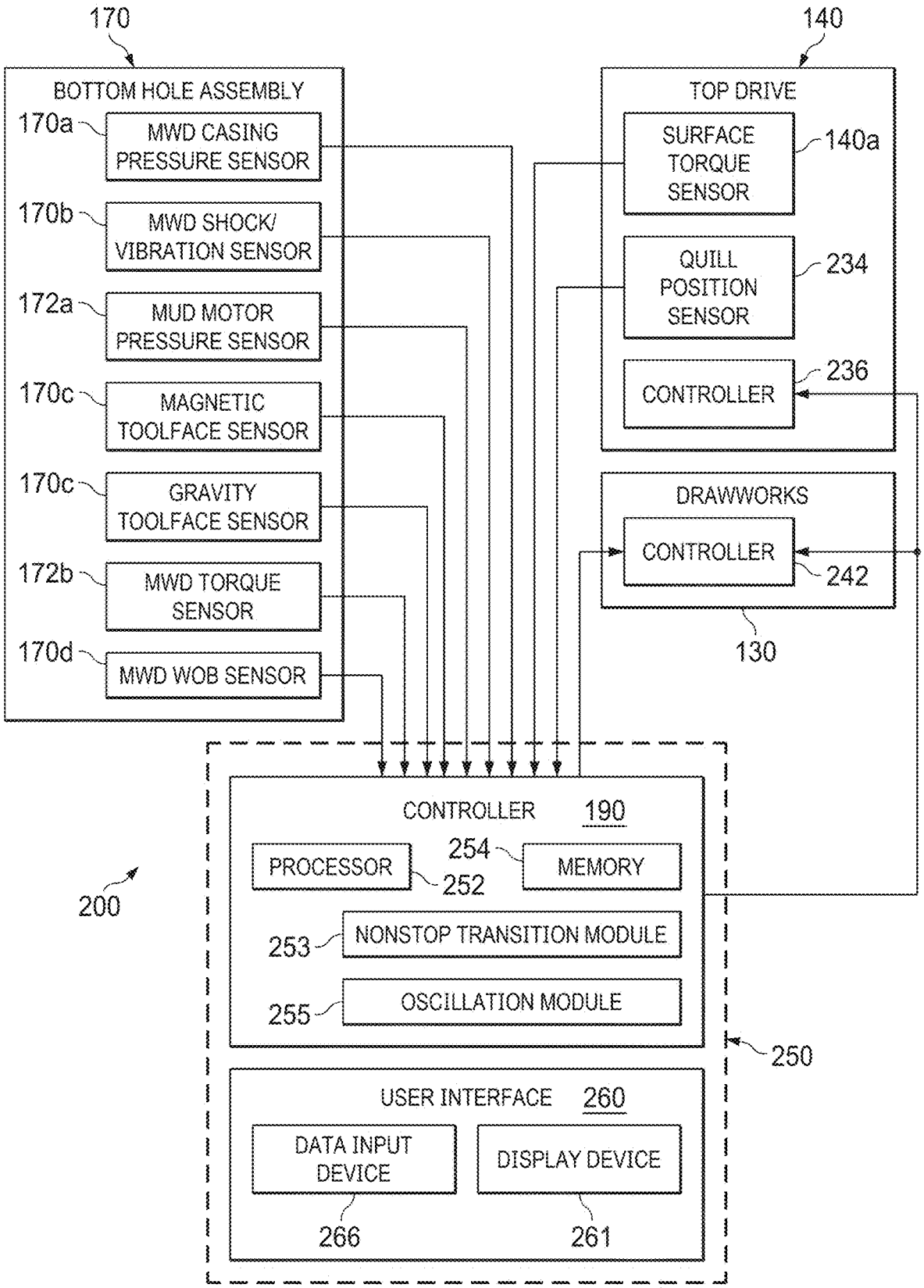
FIG. 2 illustrates an exemplary sensor and control system associated with the drilling apparatus of FIG. 1, according to one or more embodiments of the present disclosure.

The controller 190 may include a nonstop transition module 253 and an oscillation module 255 (as shown in FIG. 2). The nonstop transition module 253 and the oscillation module 255 may be part of the controller 190 or may be a separate component in communication with the controller 190. For the purpose of clarity, the controller 190, the nonstop transition module 253, and the oscillation module 255 may be referred to interchangeably. In some implementations, the controller 190 may be configured to control the operation of various systems on the apparatus 100 in relation to the nonstop transition module 253 or the oscillation module 255. For example, in response to a detected and stored torque reading and/or an input from the drilling operator, the nonstop transition module 253 may brake the top drive 140, reverse the direction of the top drive, and rotate the drill string in reverse for a determined number of rotations to remove trapped torque from the drill string. The controller 190 may also be configured to communicate prompts, status information, sensor readings, and other information to an operator, for example, on a user interface such as user interface 260 of FIG. 2. The controller 190 may communicate via wired or wireless communication channels.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

With continued reference to FIG. 1, the apparatus 100 may additionally or alternatively include a shock/vibration sensor 170*b* that is configured to detect shock and/or vibration in the BHA 170. The apparatus 100 may additionally or alternatively include a mud motor pressure sensor 172*a* that may be configured to detect a pressure differential value or range across one or more motors 172 of the BHA 170. The one or more motors 172 may each be or include a positive displacement drilling motor that uses hydraulic power of the drilling fluid to drive the drill bit 175, also known as a mud motor. One or more torque sensors 172*b* may also be included in the BHA 170 for sending data to the controller 190 that is indicative of the torque applied to the drill bit 175 by the one or more motors 172.

The apparatus 100 may additionally or alternatively include a toolface sensor 170*c* configured to detect the current toolface orientation. In some implementations, the toolface sensor 170*c* may be or include a conventional or future-developed magnetic toolface sensor which detects toolface orientation relative to magnetic north. Alternatively or additionally, the toolface sensor 170*c* may be or include a conventional or future-developed gravity toolface sensor which detects toolface orientation relative to the Earth's gravitational field. The toolface sensor 170*c* may also, or alternatively, be or include a conventional or future-developed gyro sensor. The apparatus 100 may additionally or alternatively include a weight on bit (WOB) sensor 170*d* integral to the BHA 170 and configured to detect WOB at or near the BHA 170.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b*, or position sensor, configured to detect a value or range of the rotational speed of the quill 145.

The top drive 140, drawworks 130, crown or traveling block, drilling line or dead line anchor may additionally or alternatively include or otherwise be associated with a WOB sensor 140*c* (WOB calculated from a hook load sensor that may be based on active and static hook load) (e.g., one or more sensors installed somewhere in the load path mechanisms to detect and calculate WOB, which may vary from rig to rig) different from the WOB sensor 170*d*. The WOB sensor 140*c* may be configured to detect a WOB value or range, where such detection may be performed at the top drive 140, drawworks 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection devices may include one or more interfaces which may be local at the well/rig site or located at another, remote location with a network link to the system.

FIG. 2 illustrates a block diagram of a sensor and control system 200 according to one or more aspects of the present disclosure. The sensor and control system 200 includes the controller 190, the bottom hole assembly (BHA) 170, the top drive 140, and the drawworks 130. The sensor and control system 200 may be implemented within the environment and/or apparatus shown in FIG. 1.

As described above, the controller 190 may include a processor 252 and a memory 254, as described herein with reference to FIG. 1. In addition, the controller 190 includes the nonstop transition module 253 and the oscillation module 255. Depending upon the implementation, the nonstop transition module 253 and the oscillation module 255 may form a part of or be stored within the memory 254, and may be executable by the processor 252.

The user interface 260 and the controller 190 may be discrete components that are interconnected via wired or wireless devices. Alternatively, the user interface 260 and the controller 190 may be integral components of a single system forming a larger controller, referenced herein by the number 250, as indicated by the dashed lines in FIG. 2.

The sensor and control system 200 may also include the nonstop transition module 253 and the oscillation module 255 as shown in FIG. 2. In the implementation shown, the nonstop transition module 253 and the oscillation module 255 are each a module, a subcontroller, or other component forming a part of the controller 190. Other implementations include the nonstop transition module 253 and the oscillation module 255 in communication with, but disposed separately and apart from the controller 190. Although the nonstop transition module 253 and the oscillation module 255 may be a separate component from the controller 190 in some implementations, for the sake of clarity, the nonstop transition module 253 and the oscillation module 255 will be discussed as a part of the controller 190 below. The nonstop transition module 253 may be connected to the sensor systems of the sensor and control system 200 and may be configured to determine or calculate a trapped torque, a rotational displacement, or other parameter indicative of an offset between a rotational position of the top drive 140 and the toolface angle of the drill bit 175. The oscillation module 255 may be connected to the sensor systems of the sensor and control system 200 and may be configured to determine or calculate a rotational displacement, or other parameter indicative of an offset between a rotational position of the top drive 140 and the toolface angle of the drill bit 175, and may be configured to determine or calculate an oscillation revolution amount configured to be used for oscillating the drill string 165 during a slide drilling operation.

The user interface 260 may include a data input device 266 for user input of one or more toolface set points, other set points, limits, and other input data. For example, the user interface 260 may be used to control a rotary drilling process and/or a slide drilling process. The data input device 266 may include a keypad, voice-recognition apparatus, dial, button, switch, slide selector, toggle, joystick, track ball, mouse, database and/or other conventional or future-developed data input device. The data input device 266 may support data input from local and/or remote locations. Alternatively, or additionally, the data input device 266 may include devices for user-selection of predetermined toolface set point values or ranges, such as via one or more drop-down menus. The toolface set point data may also or alternatively be selected by the controller 190 via the execution of one or more database look-up procedures. In general, the data input device 266 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other devices.

The user interface 260 may also include a display device 261 arranged to present sensor results, prompts to a controller, calculated trapped torque values, measured or sensed rotational torque values, rotational displacements, drilling rig visualizations, calculated or determined oscillation revolution amounts, as well as other information. The user interface 260 may visually present information to the user in visual form, such as textual, graphic, video, or other form, or may present information to the user in audio or other sensory form. In some implementations, the display device 261 is a computer monitor, an LCD or LED display, table, touch screen, or other display device. The user interface 260 may include one or more selectable icons or buttons to allow an operator to access information and control various systems of the drilling rig. In some implementations, the display device 261 is configured to present information related to trapped torque, rotational displacement, or drill string oscillation to an operator.

In some implementations, the sensor and control system 200 may include a number of sensors, including those described above with reference to FIG. 1. Although a specific number of sensors are shown in FIG. 2, the sensor and control system 200 may include more or fewer sensors than those disclosed. Furthermore, some implementations of the nonstop transition module 253 or the oscillation module 255 may include additional sensors not specifically described herein.

With continued reference to FIG. 2, the BHA 170 may include the MWD down hole annular pressure sensor **170*a* shown in FIG. 1. The casing pressure data detected via the MWD casing pressure sensor 212 may be sent via electronic signal to the controller 190** via wired or wireless transmission.

The BHA 210 may also include the MWD shock/vibration sensor **170*b* shown in FIG. 1. The shock/vibration data detected via the MWD shock/vibration sensor 214 may be sent via electronic signal to the controller 190** via wired or wireless transmission.

The BHA 210 may also include the mud motor pressure sensor **172*a* shown in FIG. 1**. The mud motor pressure may be alternatively or additionally calculated, detected, or otherwise determined at the surface, such as by calculating the difference between the surface standpipe pressure just off-bottom and pressure once the bit touches bottom and starts drilling and experiencing torque.

The BHA 210 may also include the toolface sensor **170*c* shown here as a magnetic toolface sensor 218 and a gravity toolface sensor 220 that are cooperatively configured to detect the current toolface. The magnetic toolface sensor may be or include a conventional or future-developed magnetic toolface sensor which detects toolface orientation relative to magnetic north. The gravity toolface sensor may be or include a conventional or future-developed gravity toolface sensor which detects toolface orientation relative to the Earth's gravitational field. In an exemplary implementation, the magnetic toolface sensor may detect the current toolface when the end of the wellbore is less than about 7° from vertical, and the gravity toolface sensor may detect the current toolface when the end of the wellbore is greater than about 7° from vertical. However, other toolface sensors may also be utilized within the scope of the present disclosure, including non-magnetic toolface sensors and non-gravitational inclination sensors. In any case, the toolface orientation detected via the one or more toolface sensors (e.g., magnetic toolface sensor and/or gravity toolface sensor) may be sent via electronic signal to the controller 190** via wired or wireless transmission.

The BHA 210 may also include the MWD torque sensor **172*b* that is configured to detect a value or range of values for torque applied to the bit by the motor(s) of the BHA 170. The torque data detected via the MWD torque sensor 172*b* may be sent via electronic signal to the controller 190** via wired or wireless transmission.

The BHA 210 may also include the MWD WOB sensor **170*d* that is configured to detect a value or range of values for WOB at or near the BHA 170. The WOB data detected via the MWD WOB sensor 170***d* may be sent via electronic signal to the controller 190 via wired or wireless transmission.

The drawworks 130 may include a controller 242 and/or other devices for controlling feed-out and/or feed-in of a drilling line (such as the drilling line 125 shown in FIG. 1). Such control may include rotational control of the drawworks (in versus out) to control the height or position of the hook, and may also include control of the rate the hook ascends or descends.

The top drive 140 may include the surface torque sensor 140*a* that is configured to detect a value or range of the reactive torsion of the quill or drill string. The drive system 230 also includes a quill position sensor 234 that is configured to detect a value or range of the rotational position of the quill, such as relative to true north or another stationary reference. The surface torsion and quill position data detected via the surface torque sensor 232 and the quill position sensor 234, respectively, may be sent via electronic signal to the controller 190 via wired or wireless transmission. The top drive 140 also includes a controller 236 and/or other devices for controlling the rotational position, speed, and direction of the quill or other drill string component coupled to the top drive 140 (such as the quill 145 shown in FIG. 1).

In one or more embodiments, the nonstop transition module 253 of the controller 190 may be configured to control the drawworks 130 and the top drive 140 to reduce or eliminate trapped torque by rotating the surface end of the drill string in reverse prior to initiating a slide drilling process, as described in U.S. Pat. No. 10,851,640, the entirety of which is hereby incorporated herein by express reference thereto. More particularly, in some embodiments, certain parameters of the top drive, such as rotational torque and speed, may be used to calculate rotational displacement which can remove trapped torque from a drill string without coming off the bottom of the wellbore. Using data analytics for example, the nonstop transition module 253 may generate a high density torque versus time graph from the instant that rotational energy is transferred to the drill string. The character of this graph may have a typical profile. It may include a sharp, almost vertical rise in torque applied to the drill string while all the frictional and drag forces in the wellbore are being engaged and overcome by the power and the top drive. This sharp rise will then break over and decrease to a close to steady-state value once the drill string has completely attained its rotation. While this occurs, the nonstop transition module 253 may store the graph, or values representative of the graph, to be drawn upon later such as prior to a slide drilling process. During this period of time that torque is ramping up, sensed or detected data may also indicate an equally high density rotational speed signal. The nonstop transition module 253 may analyze this RPM signal in real-time from a startup time until a torque breakover time or a peak time indicating that the drill string has fully attained rotation. During this time, the top drive 140 is imparting pure torque to the drill string to start it into rotational motion, but the drill string has not yet attained complete rotation because of inertia and friction. The RPM versus time curve may mimic or follow a speed versus time XY graph. By integrating the area under the RPM graph, the nonstop transition system can determine the displacement (speed*time=distance). In some embodiments, including the embodiment described above, the displacement is rotational and can be expressed as degrees, where one rotation is equal to 360°. However, other units may be used.

In one or more embodiments, the oscillation module 255 of the controller 190 may be configured to control the drawworks 130 and the top drive 140, to monitor the behavior of the drill string 165, to calculate or determine the rotational displacement stored within the drill string 165, and to calculate or determine an oscillation revolution amount to be used during slide drilling to rotate the drill string 165 back and forth (e.g., clockwise and counterclockwise) to reduce borehole sidewall friction without completely rotating the drill string 165, which could cause the drilling direction to be changed. These aspects of the oscillation module 255 will be described in more detail with respect to FIGS. 3A-3C.

Figure 3A:
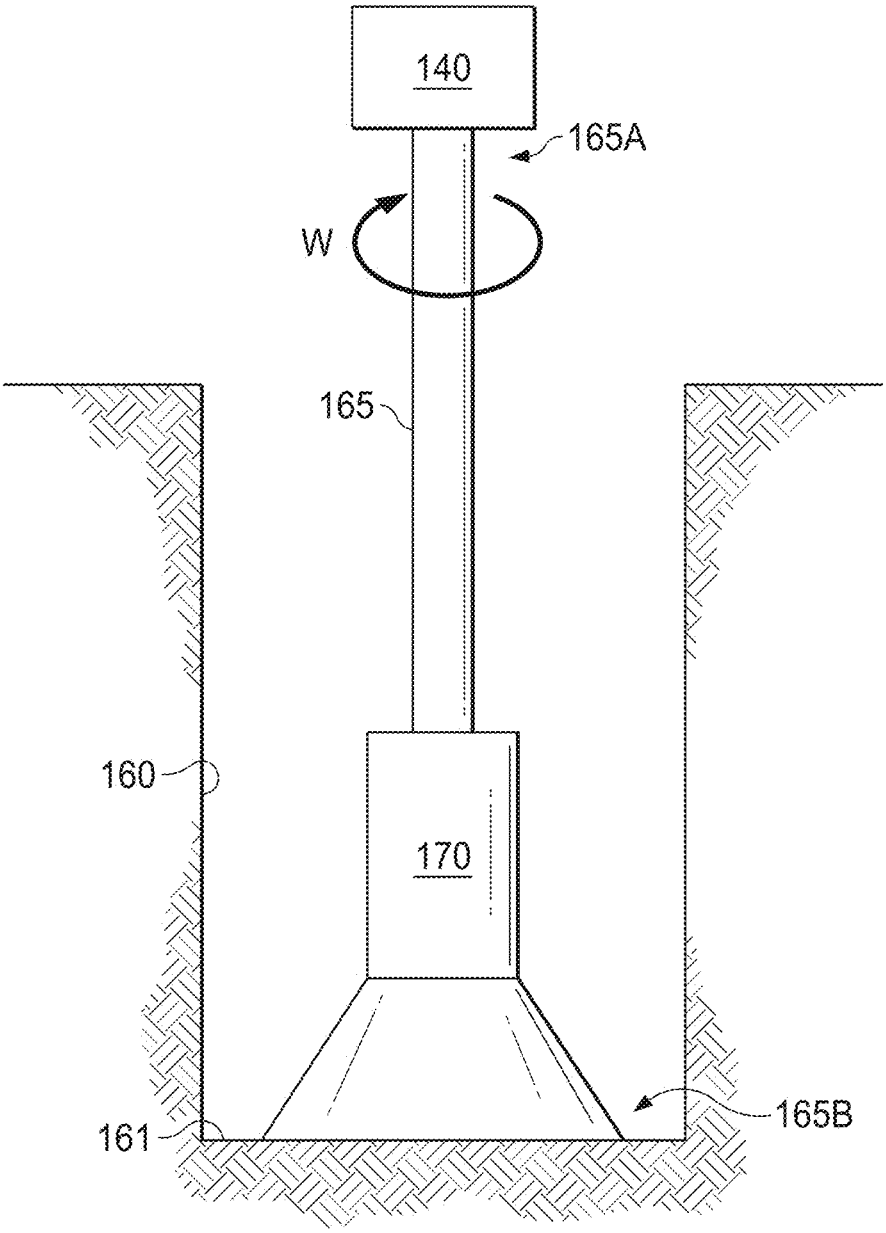
FIG. 3A illustrates a top drive, a drill string, and a bottom hole assembly (BHA) of the drilling apparatus of FIG. 1 in a first configuration in which rotary drilling is being performed, according to one or more embodiments of the present disclosure.

FIG. 3A illustrates the top drive 140, the drill string 165, and the BHA 170 in a first configuration in which rotary drilling is being performed to drill a first segment of the wellbore 160. In the first configuration, a first end 165A of the drill string 160 is operably coupled to and driven by the top drive 140. In one or more embodiments, the controller 190 sends a command to the top drive 140 to begin rotating the drill string 165 to rotary drill the first segment of the wellbore 160. In one or more embodiments, the command sent from the controller 190 to the top drive 140 includes a top drive RPM setpoint associated with a speed at which the top drive 140 should rotate the drill string 165. While the drill string 165 is being driven by the top drive 140 in the first configuration, the first end 165A of the drill string 165 is effectively pinned, fixed, or locked such that the drill string 165 at the first end 165A cannot rotate in a direction opposite to the direction in which the drill string 165 is being driven by the top drive 140, or such that the drill string 165 at the first end 165A cannot release a trapped torque stored in the drill string 165. Furthermore, in the first configuration, a second end 165B of the drill string 165, which second end 165B may include the BHA 170, is on or in contact with a bottom 161 of the wellbore 160. This is sometimes referred to as the drill string 165 or the BHA 170 being "on bottom". While the second end 165B of the drill string 165 is on the bottom 161 of wellbore 160 in the first configuration, the second end 165B of the drill string 165 is effectively pinned, fixed, or locked such that the drill string 165 at the second end 165B cannot rotate in a direction opposite to the direction in which the drill string 165 is being driven by the top drive 140, or such that the drill string 165 at the second end 165B cannot release a trapped torque stored in the drill string 165.

As discussed above, during rotary drilling, an amount of torque imparted into the drill string 165 by the top drive 140 is used to overcome bore friction and drag in the wellbore 160. This amount of torque, sometimes referred to as "trapped torque," exists in the drill string 165 between the top drive 140 and the BHA 170 and is the result of a lag between rotation at the first end 165A of the drill string 165 and rotation at the second end 165B of the drill string 165, sometimes referred to as "rotational displacement". In one or more embodiments, this rotational displacement of the drill string 165 may be expressed as a number of wraps of the drill string 165. As used herein, the term wraps refers to rotation of the drill string, with one wrap equaling 360-degrees of drill string rotation. In one or more embodiments, the rotation of the BHA 170 at the second end 165B of the drill string 165 may lag the rotation of the first end 165A of the drill string 165 at the top drive 140 by many revolutions, resulting in a substantial amount of trapped torque and a substantial number of wraps of the drill string 165. As shown in FIG. 3A, W wraps have been imparted on the drill string 165 as a result of top drive 140 driving and rotating the drill string 165 and as a result of the bore friction and drag experienced by the drill string 165 in the wellbore 160.

In one or more embodiments, while rotary drilling of the first segment of the wellbore 160 is being performed, the oscillation module 255 may receive data from the one or more sensors of the apparatus 100 described above to monitor one or more operating parameters of the apparatus 100. In one or more embodiments, the sensors from which the oscillation module 255 may receive data include, but are not limited to, the quill position sensor 234, the WOB sensor 140C, and the MWD WOB sensor 170D. In one or more embodiments, the data may be received from the sensors every second in real time, or near real time. In one or more embodiments, the data may be organized and displayed in a table or graph. In one or more embodiments, the quill position sensor 234 may communicate a rotational position or rotational orientation of the quill 145 or of the first end 165A of the drill string 165 to the oscillation module 255. In one or more embodiments, the quill position sensor 234 may communicate a top drive RPM associated with the quill 145 or the first end 165A of the drill string 165 to the oscillation module 255. In one or more embodiments, the WOB sensor 140C or the MWD WOB sensor 170D may communicate data associated with the WOB of the drill string 165 and the BHA 170 to the oscillation module 255, which may be used to determine whether the drill string 165 or the BHA 170 is on the bottom 161 of the wellbore 160. In one or more embodiments, the determination of whether the drill string 165 or the BHA 170 is on the bottom 161 of the wellbore 160 using the data received from the sensors may be organized and represented as a binary determination, meaning either the drill string 165 or the BHA 170 is on bottom (e.g., "1") or the drill string 165 or the BHA 170 is not on bottom (e.g., "0"). As will be described below, the data received by the oscillation module 255 is used to determine that W wraps have been imparted on and stored in the drill string 165.

Figure 3B:
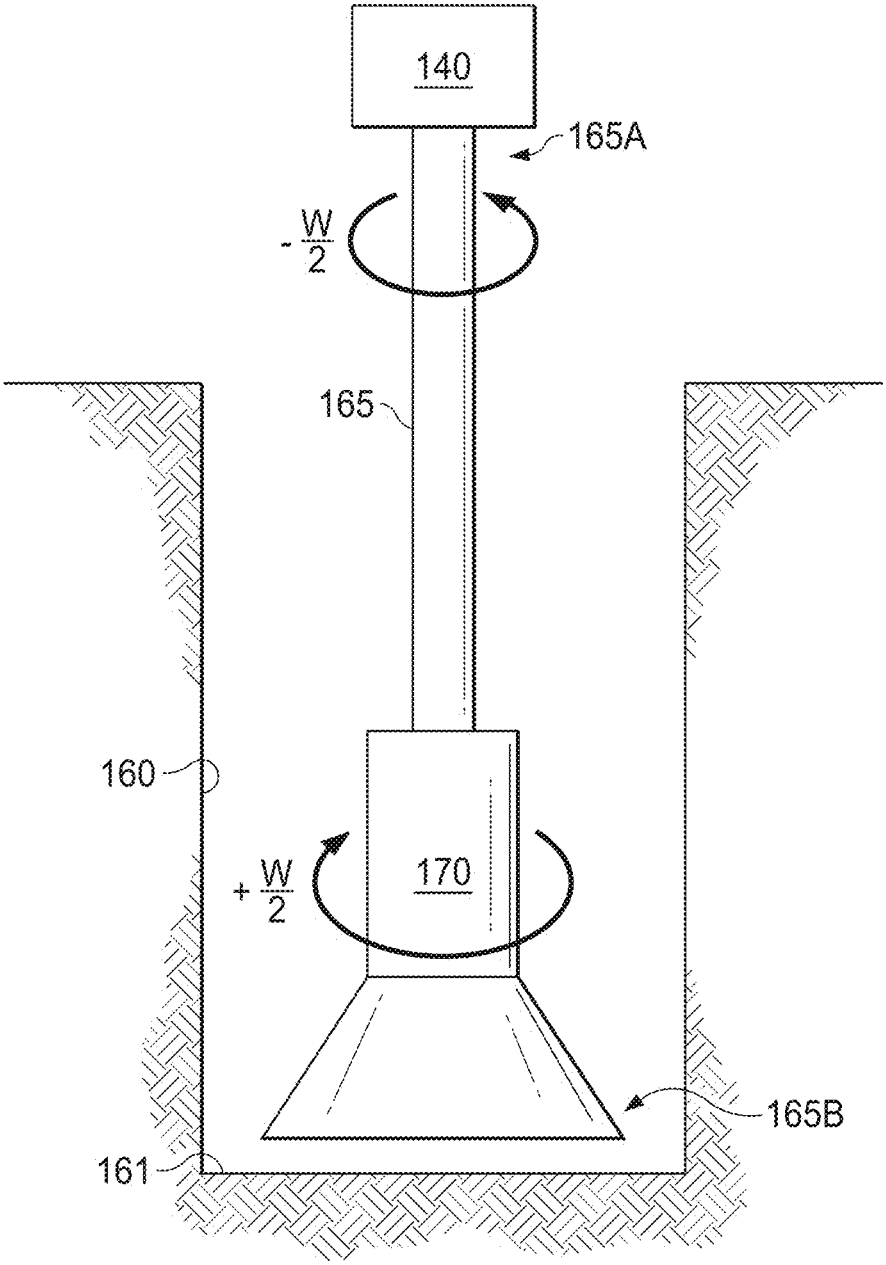
FIG. 3B illustrates the top drive, the drill string, and the BHA of FIG. 3A in a second configuration in which trapped torque is released from the drill string, according to one or more embodiments of the present disclosure.

FIG. 3B illustrates the top drive 140, the drill string 165, and the BHA 170 in a second configuration in which rotary drilling of the first segment of the wellbore 160 has been completed. In one or more embodiments, completion of the first segment of the wellbore 160 may mean that the drilling operation is going to transition from rotary drilling to slide drilling, which may require the rotation of the drill string 165 driven by the top drive 140 to be stopped before transitioning to slide drilling. In one or more other embodiments, completion of the first segment of the wellbore 160 may mean that a rotary stand has been completed, which may require rotation of the drill string 165 driven by the top drive 140 to be stopped so that another rotary stand made be added to the drill string 165 before rotatory drilling operations are resumed. As used herein, a rotary stand refers to a unit or section of drill pipe, multiple of which may be connected together to create the drill string 165. As the wellbore 160 increases in depth, additional rotary stands may be added to the drill string 165 to lengthen the drill string 165. In one or more embodiments, completion of the first segment of the wellbore 160 may mean adjusting the top drive RPM setpoint to 0-RPM. In one or more embodiments, completion of the first segment of the wellbore 160 may mean adjusting the top drive RPM setpoint to 0-RPM and the second end 165B of the drill string 165 drilling off its weight.

As used herein, drilling off the weight refers to a situation where the drill string 165 is no longer being lowered into the wellbore 160 and thus, as the BHA 170 continues to drill the wellbore 160 or bleed off its angular momentum, the BHA 170 will eventually no longer be in contact with the bottom 161 of the wellbore 160, at which point the WOB is zero. Once the BHA 170 has drilled of its weight, the BHA 170 is no longer in contact with the bottom 161 of the wellbore 160. In some embodiments, once the BHA 170 has drilled off its weight, the BHA 170 may still maintain some angular rotation until all angular momentum has been bled off after the top drive RPM setpoint has been set to 0-RPM. In other embodiments, the BHA 170 may be said to have drilled off its weight once the BHA 170 is no longer in contact with the bottom 161 of the wellbore 160 and once its angular momentum has been bled off.

In one or more embodiments, in association with the completion of the first segment of the wellbore 160, the controller 190 may send a command to the drawworks 130 to stop lowering the drill string 165 into the wellbore 160 and a command to the top drive 140 to stop rotating the drill string 165. In one or more embodiments, to stop the rotation of the drill string 165 driven by the top drive 140, the command sent from the controller 190 to the top drive 140 may include a command or instruction to change the top drive RPM setpoint to 0-RPM. As the rotation of the drill string 165 and the BHA 170 driven by the top drive 140 slows, the contact between the BHA 170 and the bottom 161 of the wellbore 160 becomes zero as the BHA 170 drills off its weight because the drill string 165 is no longer being lowered into the wellbore 160. As discussed above, the data communicated to the oscillation module 255 from the WOB sensor 140C or the MWD WOB sensor 170D includes WOB information associated with the drill string 165 and the BHA 170 and, in one or more embodiments, may be used by the oscillation module 255 to determine whether the BHA 170 is on the bottom 161 of the wellbore 160.

Once the BHA 170 drills off its weight and is no longer in contact with the bottom 161 of the wellbore 160, as shown in FIG. 3B, the second end 165B of the drill string 165 becomes free, such that the second end 165B of the drill string 165 is no longer pinned, fixed, or locked. In one or more embodiments, the WOB information of the data received from the WOB sensor 140C or the MWD WOB sensor 170D may indicate or may be used to determine that the second end 165B of the drill string 165 has become free when the WOB is zero or negligible. Furthermore, once the top drive RPM setpoint is set to 0-RPM and/or the rotation of the top drive 140 comes to a stop or reaches 0-RPM, as shown in FIG. 3B, the first end 165A of the drill string 165 is arranged to become rotationally free, such that the first end 165A of the drill string 165 is no longer pinned, fixed, or locked. This can be achieved by, e.g., disengaging any rotational force via the quill, motor, or otherwise at the top drive 140. In other words, although the drill string 165 may still be connected to the top drive 140 once the top drive RPM setpoint has been set to 0-RPM and/or the rotation of the top drive 140 has reached 0-RPM, the top drive 140 is no longer driving or powering rotation of the drill string 165.

In one or more embodiments, the first end 165A of the drill string 165 and the second end 165B of the drill string 165 may become rotationally free simultaneously or nearly simultaneously. In one or more embodiments, the second end 165B of the drill string 165 becomes free prior to the first end 165A of the drill string 165 becoming free because the BHA 170 drills off its weight and is no longer in contact with the bottom 161 of the wellbore 160 before the top drive RPM setpoint is set to 0-RPM or before the rotation of the top drive 140 comes to a stop or reaches 0-RPM. In one or more embodiments, the second end 165B will typically become free before the first end 165A becomes free because it is advantageous to ensure the BHA 170 has drilled off its weight before the top drive 140 stops rotating the drill string 165. In one or more embodiments, the second end 165B may become at least partially free before the first end 165A becomes free because the second end 165B may become at least partially free once it has substantially, but not yet completely, drilled off its weight and thus may be considered at least partially off bottom.

Once one or both of the first end 165A and the second end 165B of the drill string 165 become free, the trapped torque, rotational displacement, or wraps stored in the drill string 165 are released as the natural behavior of the drill string 165 will be to return to a state of equilibrium or an unloaded state in which there is no torque, rotational displacement, or wraps stored in the drill string 165. In one or more embodiments, the trapped torque, rotational displacement, or wraps are released by the drill string 165 untwisting itself. Theoretically, when both ends of the drill string 165 become free or rotationally free, half of the wraps stored in the drill string 165 will be released in one rotational direction at one end of the drill string 165 and the other half of the wraps stored in the drill string 165 will be released in the opposite rotational direction at the other end of the drill string 165. However, in reality, due to variations in friction within the wellbore 160 and possibly also at the top drive, the ends of the drill string 165 becoming free or rotationally free at different times, and other factors, the trapped torque stored in the drill string 165 may not be released equally at each end of the drill string 165. In one or more embodiments, the trapped torque travels and releases itself along the path of least resistance with respect to the drill string 165 in the wellbore 160.

In one or more embodiments, where W wraps are stored in the drill string 165 as a result of the rotation of the top drive 140 and the friction in the wellbore 160, and where both the first end 165A and the second end 165B of the drill string 165 have become free or rotationally free upon the completion of the first segment of the wellbore 160, W/2 wraps may be released at the first end 165A of the drill string 165 and W/2 wraps may be released at the second end 165B of the drill string 165, as illustrated in FIG. 3B. In one or more embodiments, the W/2 wraps released at the second end 165B of the drill string 165 may be released by the second end 165B of the drill string 165 untwisting and rotating in the rotational direction in which the top drive 140 had been rotating the drill string 165 while drilling the first segment of the wellbore 160. In one or more embodiments, the W/2 wraps released at the first end 165A of the drill string may be released by the first end 165A of the drill string 165 untwisting and rotating in a rotational direction opposite to the rotational direction in which the top drive 140 had been rotating the drill string 165 while drilling the first segment of the wellbore 160. In one or more embodiments, where the top drive 140 rotates the drill string 165 in the clockwise direction in the first configuration illustrated in FIG. 3A, in the second configuration illustrated in FIG. 3B the release of the trapped torque, rotational displacement, or wraps stored in the drill string 165 will be experienced as a clockwise rotation of the second end 165B of the drill string 165 and will be experienced as a counterclockwise rotation, or a reverse rotation, of the first end 165A of the drill string 165.

In one or more embodiments, when the first end 165A of the drill string 165 becomes rotationally free and the drill string 165 begins to release the trapped torque, rotational displacement, or wraps stored in the drill string 165, the first end 165A of the drill string 165 is still coupled to the quill 145 of the top drive 140. Although the first end 165A of the drill string 165 remains coupled to the top drive 140 in such embodiments, the top drive 140 is no longer driving or powering rotation of the drill string 165 in the second configuration, making the first end of the drill string 165A rotationally free. Thus, as the first end 165A of the drill string 165 begins to untwist, the reverse rotation of the first end 165A of the drill string 165 is a free reverse rotation that is caused by the natural untwisting of the drill string 165 as the trapped torque is released. Such free reverse rotation of the first end 165A of the drill string 165 is not a driven or powered rotation of the first end 165A by the top drive 140; however, because the first end 165A of the drill string 165 is still coupled to the top drive, the free reverse rotation is imparted on the quill 145 of the top drive 140 such that the free reverse rotation of the first end 165A is experienced by, and capable of measurement by, the top drive 140.

As discussed above, in one or more embodiments, the quill position sensor 234 is configured to measure and communicate data, including a top drive RPM associated with the quill 145 or the first end 165A of the drill string 165, to the oscillation module 255. In one or more embodiments, the quill position sensor 234 continues to measure the top drive RPM after completion of the rotary drilling process and after the top drive RPM setpoint has been set to 0-RPM. In one or more embodiments, the quill position sensor 234 measures the top drive RPM in one second time intervals and communicates the top drive RPM as data to the oscillation module 255 in real time or near real time. In one or more embodiments, the quill position sensor 234 continuously measures the top drive RPM before, during, and after the rotary drilling process.

In one or more embodiments, after the first segment has been completed, the top drive RPM setpoint has been set to 0-RPM, and the first end 165A of the drill string 165 has become rotationally free, the top drive RPM measured by the quill position sensor 234 and communicated to the oscillation module 255 will begin to decrease and approach 0-RPM. As the quill position sensor 234 and the oscillation module 255 continuously measure the top drive RPM, there will be a clear time window in the data where the measured top drive RPM will become negative, corresponding to the reverse rotation experienced by the top drive 140 as the first end 165A of the drill string 165 begins to untwist and release the trapped torque, rotational displacement, or wraps stored in the drill string 165. This negative top drive RPM associated with the reverse rotation of the first end 165A of the drill string 165 is directly associated with the behavior of the drill string 165 and can be used, in one or more embodiments, to facilitate calculating the total rotational displacement, or total number of wraps, stored in the drill string 165.

In one or more embodiments, each of, or at least a portion of, the negative top drive RPM data points, which correspond to the reverse rotation of the first end 165A of the drill string 165 as the drill string 165 releases the trapped toque stored therein, received by the oscillation module 255 or the controller 190 from the quill position sensor 234 in one second intervals may be summed to determine the number of rotations or wraps released at the first end 165 of the drill string 165. In one or more embodiments, while the first end 165A of the drill string 165 is untwisting and thereby imparting a reverse rotation on the top drive 140, the quill position sensor 234 may measure and communicate to the oscillation module 255 a plurality of top drive RPM measurements $RPM_1$, $RPM_2$, $RPM_3$, . . . $RPM_N$ taken at one second time intervals that correspond to the reverse rotation of the top drive 140 and the first end 165A of the drill string 165. In one or more embodiments, each of the plurality of top drive RPM measurements $RPM_1$, $RPM_2$, $RPM_3$, . . .

$RPM_N$ is a negative RPM. In one or more embodiments, each of the plurality of top drive RPM measurements $RPM_1$, $RPM_2$, $RPM_3$, . . . $RPM_N$ may be divided by 60 seconds to express each of the top drive RPM measurements as the number of rotations, or fractions of rotations, per second of the top drive 140 and of the first end 165A of the drill string 165. Then, in one or more embodiments, the plurality of top drive RPM measurements, taken in one second time intervals (or other suitable periodic measurement, such as 0.1 seconds, 0.5 seconds, or 1.5 seconds, or the like), may be summed to calculate the number of wraps of the drill string 165 released at the first end 165A of the drill string 165. As discussed above, an equal number of wraps would theoretically be released at the second end 165B of the drill string 165 as were released at the first end 165A of the drill string 165. Understanding this principle, the calculated number of wraps released at the first end 165A of the drill string 165 can be doubled to calculate the total number of wraps (i.e., W wraps) that were stored in the drill string 165. For example, the controller 190, using the oscillation module 255 and the plurality of top drive RPM measurements $RPM_1$, $RPM_2$, $RPM_3$, . . . $RPM_N$ received from the quill position sensor 234 of the top drive 140 that correspond to the reverse rotation of the top drive 140 and the first end 165 of the drill string 165, may calculate the total number of wraps W stored in the drill string 165 using Equation 1 below.

$$W = 2\left(\frac{RPM_1}{60} + \frac{RPM_2}{60} + \frac{RPM_3}{60} + \ldots \frac{RPM_N}{60}\right) \quad \text{Equation 1}$$

In one or more embodiments, an equal number of rotations may not occur at each end of the drill string 165 as the trapped torque is being released. As discussed above, the second end 165B of the drill string 165 may become free before the first end 165A of the drill string 165. In such situations, a greater amount of untwisting of the drill string 165 would occur at the second end 165B as compared to the first end 165A. In other words, a greater number of wraps would be released at the second end 165B as compared to the first end 165A. Because the untwisting of the drill string 165A is only measured at the first end 165A of the drill string 165, the calculated number of wraps stored in the drill string 165 using Equation 1 may be less than the total number of wraps actually stored in the drill string 165. As such, in one or more embodiments, the total number of wraps W calculated to be stored in the drill string 165 using Equation 1 may be a minimum number of wraps that are potentially stored in the drill string 165.

Figure 3C:
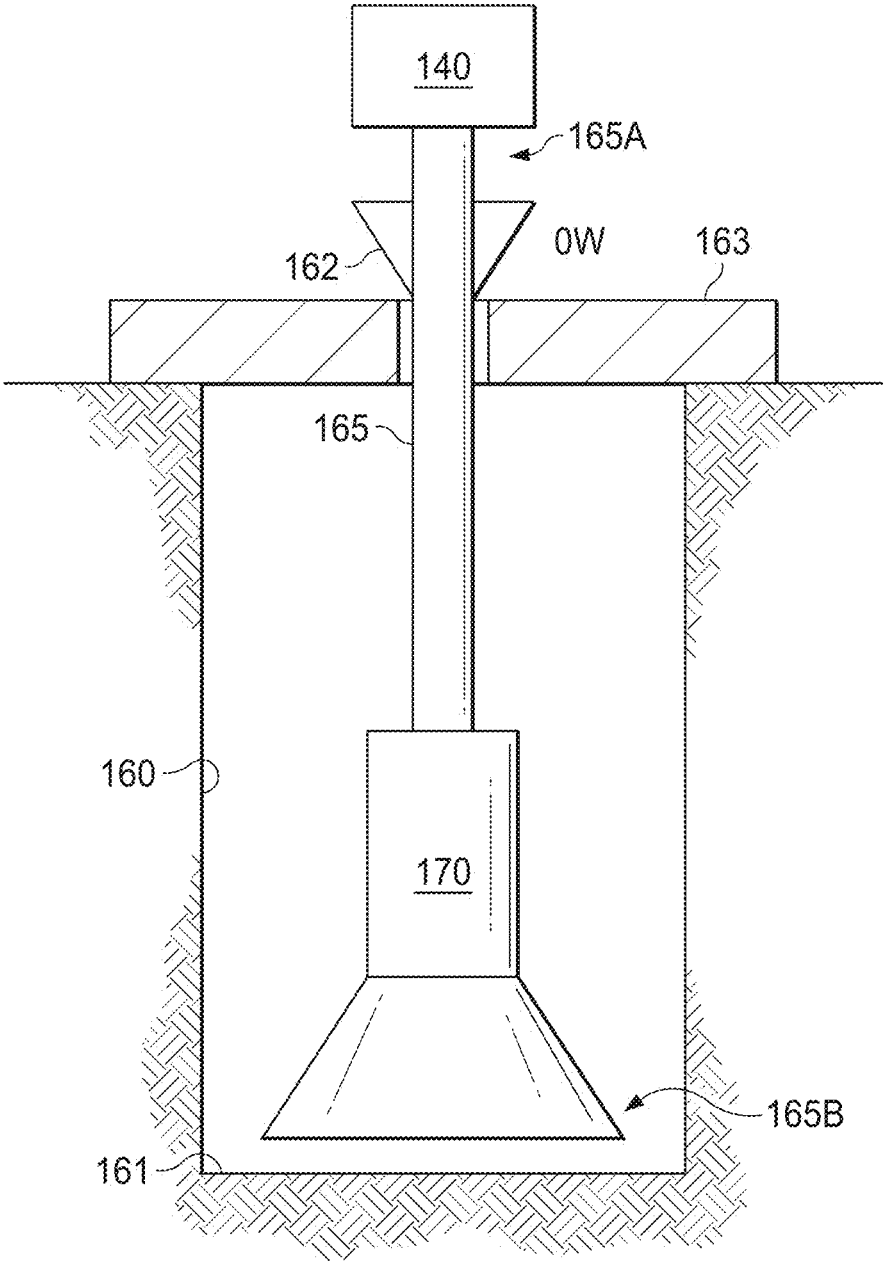
FIG. 3C illustrates the top drive, the drill string, and the BHA of FIG. 3A in a third configuration in which the drill string is put into slips, according to one or more embodiments of the present disclosure.

FIG. 3C illustrates the top drive 140, the drill string 165, and the BHA 170 in a third configuration in which all, or substantially all, of the trapped torque, rotational displacement, or wraps stored in the drill string 165 have been released such that the drill string 165 is unloaded and has zero wraps remaining stored therein. In the embodiment shown in FIG. 3C, once the trapped torque has been released from the drill string 165, the drill string 165 is placed into slips 162 that hold and support the weight of the drill string 165 so that the drill string 165 can be disconnected from the top drive 140, or so that two rotary stands of the drill string 165 can be disconnected, without the drill string 165 dropping into the wellbore 160. In one or more embodiments, the slips 162 may be wedged into, supported by, and prevented from falling into the wellbore by a rotary table 163 or another element of the apparatus 100 positioned near the rig floor 110 and around the wellbore 160, which enables the slips 162, or other element, to support the weight of the drill string 165. In one or more embodiments, the drill string 165 is placed into the slips 162 so that an additional rotary stand can be added to the drill string 165.

Figure 4:
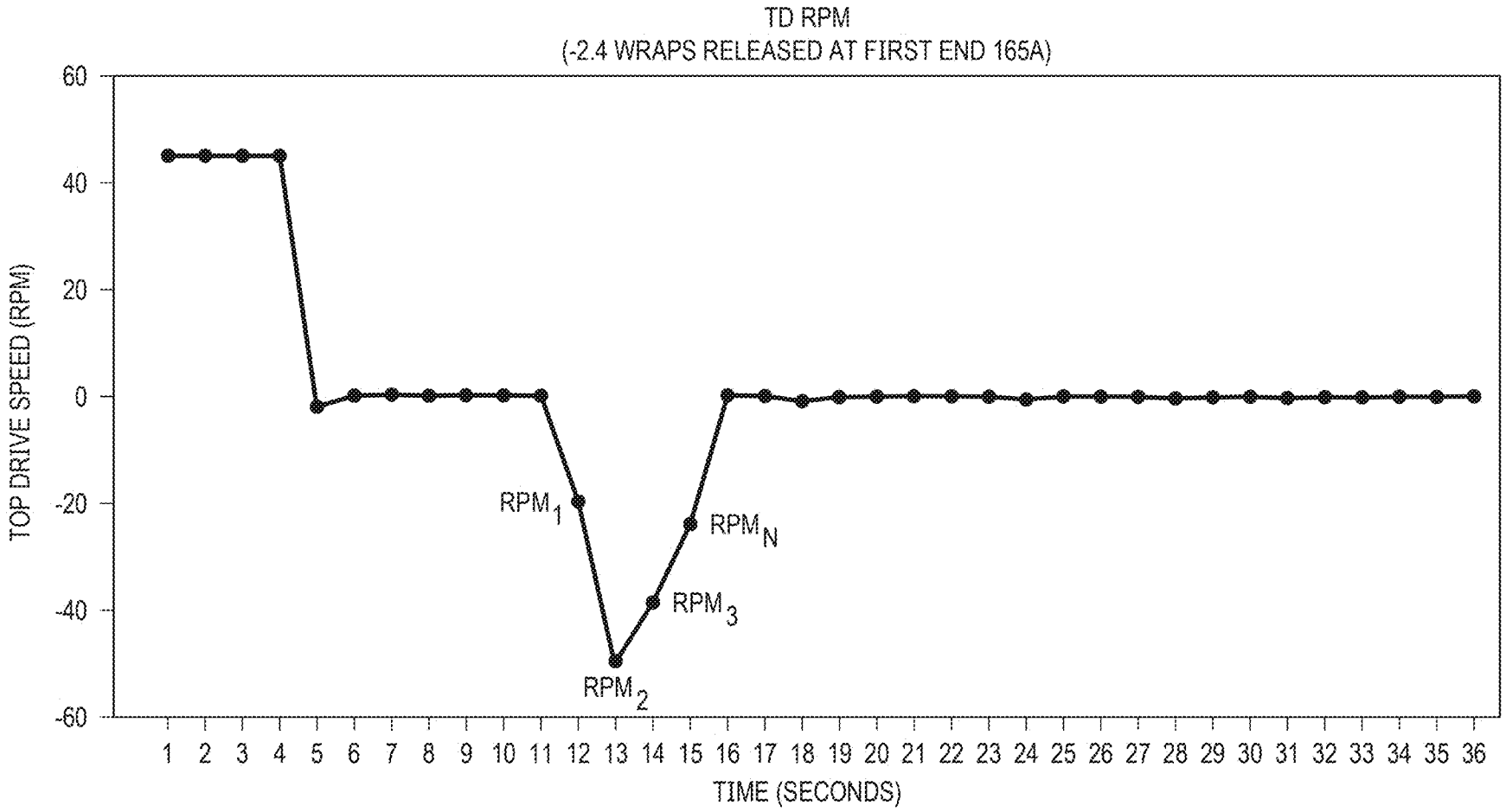
FIG. 4 illustrates a graph showing selected operating parameters associated with the top drive in at least the second configuration of FIG. 3B, according to one or more embodiments.

FIG. 4, with continued reference to FIGS. 3A-3C, illustrates an exemplary graph of the top drive RPM measurements captured by the quill position sensor 234 in one second time intervals. In the embodiment shown in FIG. 4, the top drive RPM measurements captured during the time period from 1-second through 5-seconds correspond to the first configuration of FIG. 3A in which the top drive 140 is driving and rotating the drill string 165. Thus, during the time period from 1-second through 5-seconds, the top drive RPM measurements are positive. In the embodiment shown in FIG. 4, the top drive RPM measurements $RPM_1$, $RPM_2$, $RPM_3$, . . . $RPM_N$ captured during the time period from 11-seconds through 16-second correspond to the second configuration of FIG. 3B in which the first end 165A of the drill string 165 is free and unwrapping itself and imparting a reverse rotation on the top drive 140. Thus, during the time period from 11-seconds through 16-seconds, the top drive RPM measurements $RPM_1$, $RPM_2$, $RPM_3$, . . . $RPM_N$ are negative. In one or more embodiments, the top drive RPM measurements $RPM_1$, $RPM_2$, $RPM_3$, . . . $RPM_N$ collected during the time period from 11-second through 16-seconds can be used in conjunction with Equation 1 above to calculate the number of wraps released at the first end 165A of the drill string 165. For example, in the embodiment illustrated in FIG. 4, using the top drive RPM measurements $RPM_1$, $RPM_2$, $RPM_3$, . . . . $RPM_N$ collected during the time period from 11-seconds through 16-seconds and Equation 1, it can be calculated that about 2.4 wraps of the drill string 165 were released at the first end 165A. In the embodiment shown in FIG. 4, the top drive RPM measurements captured during the time period from 16-seconds through 36-seconds correspond to the third configuration of FIG. 3C in which the top drive 140 is not rotating the drill string 165 and in which the drill string 165 is unloaded, having released the trapped torque stored therein. Thus, during the time period from 16-seconds through 36-seconds, the top drive RPM measurements are zero.

With continued reference to FIGS. 1-4, once the oscillation module 255 has calculated the number of wraps stored in the drill string 165 using the data received from the top drive 140 as described above, the oscillation module 255 is configured to implement the calculated number of wraps into an oscillation regime to be used during slide drilling. As discussed above, although the drill string 165 is not rotated during slide drilling, to reduce friction between the wellbore 160 and the drill string 165 during the slide, the oscillation module 255 is configured to implement an oscillation regime using the top drive 140 to oscillate or rotationally rock the drill string left and right, or clockwise and counterclockwise, during the slide to reduce drag of the drill string 165 in the wellbore 160. As also discussed, too much oscillation can disrupt the direction of the drill bit, sending it off-course during the slide drilling process, and too little oscillation can minimize the benefits of the friction reduction, resulting in low WOB and overly slow and inefficient slide drilling. Thus, the optimum amount of oscillation in the drill string 165 is that which almost completely rotates the drill string 165 without doing so.

Typically, operators of the drilling apparatus 100 during slide drilling use less oscillation than optimal. Because the consequence of using too much oscillation is that the entire drill string 165 could rotate, defeating the purpose of steering the directional motor, operators are extremely conservative in selecting an oscillation amount at the expense of slide drilling penetration rate.

As provided herein, calculating the number of wraps stored in the drill string 165 based on the reverse rotation of the first end 165A of the drill string 165 as the drill string 165 releases the trapped torque stored therein is based directly on the behavior of the drill string. Thus, in one or more embodiments, the number of wraps calculated using Equation 1 and the top drive RPM measurements provides an oscillation value that is close to the optimum oscillation value. In one or more embodiments, as discussed above, the calculated number of wraps may be considered a minimum number of wraps due to a greater number of wraps having been released at the second end 165B of the drill string 165 compared to the first end 165A. In one or more embodiments, the calculated number of wraps may be used by the oscillation module as a minimum oscillation value, or a starting oscillation value, to implement during slide drilling to reduce friction in the wellbore 160. In one or more embodiments, the oscillation value can be increased from the minimum oscillation value during the performance of slide drilling. However, establishing a minimum oscillation value using the number of wraps calculated as disclosed herein advantageously improves slide drilling performance and improves the economics of wellbore drilling with directional motors.

In one or more embodiments, using the calculated number of wraps as described above as an oscillation value during slide drilling means the oscillation module 255 commands the top drive 140 to rotate the drill string 165 a number of rotations in each direction (e.g., right and left, or clockwise and counterclockwise) that is equal to the calculated number of wraps. This can be achieved because, as described above, the calculated number of wraps is a known number of wraps that can be imparted on and stored in the drill string 165 without completely rotating the drill string 165.

Figure 5:
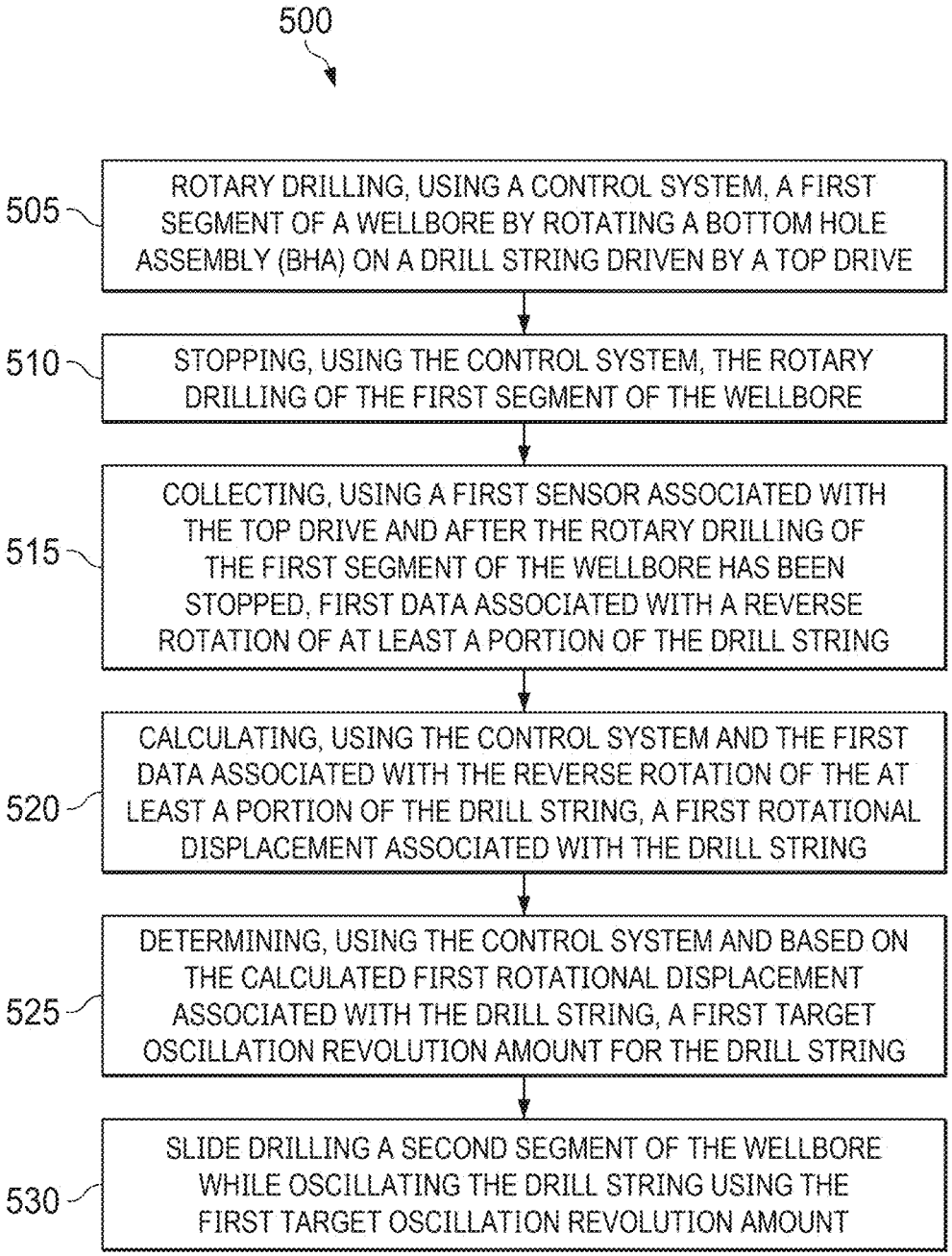
FIG. 5 illustrates a method of operating the drilling apparatus of FIG. 1, according to one or more embodiments of the present disclosure.

FIG. 5 illustrates a method 500 for operating the drilling apparatus 100, and more specifically, a method for calculating the number of wraps stored in a drill string as a result of the torque imparted on the drill string by a top drive and further as a result of friction between the drill string and a wellbore, and for using the calculated number of wraps to oscillate the drill string during slide drilling. In one or more embodiments, method 500 may be executed using the oscillation module 255 stored on the controller 190.

At step 505, a first segment of a wellbore is rotary drilled, using a control system, by rotating a bottom hole assembly ("BHA") on a drill string driven by a top drive. In one or more embodiments, the control system may be controller 190. In one or more embodiments, the wellbore may be wellbore 160. In one or more embodiments, the BHA may be BHA 170. In one or more embodiments, the drill string may be drill string 165. In one or more embodiments, the top drive may be top drive 140. In one or more embodiments, the rotation of the drill string driven by the top drive in step 505 introduces a rotational displacement into the drill string. In one or more embodiments, the rotational displacement introduced into the drill string results in a trapped torque being stored in the drill string.

At step 510, the rotary drilling of the first segment of the wellbore is stopped using the control system. In one or more embodiments, prior to stopping the rotary drilling, a command is transmitted from the control system to a controller of the top drive to stop the rotation of the drill string driven by the top drive. In one or more embodiments, the control system of the top drive may be controller 236. In one or more embodiments, stopping the rotation of the drill string driven by the top drive is associated with freeing at least one end of the drill string. In one or more embodiments, stopping the rotation of the drill string driven by the top drive frees a first end of the drill string that is operably coupled to the top drive. In one or more embodiments, the first end of the drill string is first end 165A. In one or more embodiments, freeing the at least one end of the drill string causes the trapped torque stored in the drill string to be released. In one or more embodiments, method 500 includes releasing the trapped torque stored in the drill string by freeing the at least one end of the drill string. In one or more embodiments, stopping the rotary drilling of the first segment of the wellbore enables the trapped torque stored in the drill string to be released.

At step 515, data associated with a reverse rotation of at least a portion of the drill string is collected using a sensor associated with the top drive after the rotary drilling of the first segment has been stopped. In one or more embodiments, the reverse rotation of the at least a portion of the drill string is associated with a release of the trapped torque stored in the drill string. In one or more embodiments, the reverse rotation of the at least a portion of the drill string is experienced at the first end of the drill string that is operably coupled to the top drive. In one or more embodiments, the reverse rotation of the at least a portion of the drill string is imparted on and therefore measurable by the top drive. In one or more embodiments, the sensor associated with the top drive may be quill position sensor 234. In one or more embodiments, the sensor is configured to measure a top drive RPM associated with the top drive.

At step 520, a rotational displacement associated with the drill string is calculated using the control system and the data associated with the reverse rotation of the at least a portion of the drill string. In one or more embodiments, the rotational displacement may be calculated using Equation 1 disclosed above. In one or more embodiments, the rotational displacement may be expressed as a number of wraps stored in the drill string.

At step 525, a target oscillation revolution amount for the drill string is determined using the control system and based on the calculated rotational displacement associated with the drill string. In one or more embodiments, the target oscillation revolution amount is an oscillation amount that the drill string can be rotating in each direction during slide drilling to reduce friction between the drill string and the wellbore without changing a toolface orientation of the BHA.

At step 530, using the control system, a second segment of the wellbore is slide drilled while oscillating the drill string using the target oscillation revolution amount.

In one or more embodiments, the target oscillation revolution amount may define a minimum oscillation value of a target oscillation revolution range. The target oscillation revolution amount calculated using the reverse rotation data after rotary drilling has been stopped may define a minimum oscillation value because, as described above, some of the trapped torque stored in the drill string may begin to release at the bottom of the drill string in the wellbore before the trapped torque begins to release at the top of the drill string where it can be measured by the top drive. Thus, in one or more embodiments, such a calculated target oscillation revolution amount may be considered a minimum or starting oscillation value in a target oscillation revolution range.

In one or more embodiments, another target oscillation revolution amount may be calculated using the systems and methods described in U.S. Pat. No. 10,851,640. In such embodiments, a torque sensor of the top drive may be used to collect data associated with a rotational torque applied to the drill string by the top drive during a startup process of rotary drilling a segment of a wellbore. During the startup process, the torque applied by the top drive to the drill string continues to increase until it reaches a steady state after applying enough torque to overcome the static friction of the drill string in the wellbore and to begin rotating the entire drill string. In one or more embodiments, the torque applied by top drive during the startup process may be used to determine a rotational displacement imparted on the drill string during the startup process. In one or more embodiments, a position sensor of the top drive may collect data associated with the angular position of the top drive and/or drill string during the startup process. In one or more embodiments, the data associated with the torque applied by the top drive and the angular position changes of the top drive and/or drill string during the startup process may be used to determine or calculate the rotational displacement imparted on and stored in the drill string. In one or more embodiments, this rotational displacement may be used to determine another target oscillation revolution amount.

Because the systems and methods of U.S. Pat. No. 10,851,640 for calculating the rotational displacement introduced into the drill string are based on the power and torque measurements of the top drive during the startup process, the resultant calculated rotational displacement may define a maximum oscillation value in the target oscillation revolution range.

In one or more embodiments, a first target oscillation revolution amount determined based on the reverse rotation data collected after rotary drilling has been stopped may define a minimum oscillation value in a target oscillation revolution range and a second target oscillation revolution amount determined based on the torque applied by the top drive to a drill string during a startup process of rotary drilling may define a maximum oscillation value in the target oscillation revolution range. In one or more embodiments, slide drilling a segment of a wellbore may be performed while oscillating the drill string within the target oscillation revolution range bounded, or bookended, by the minimum oscillation value and the maximum oscillation value defined above.

For example, in one or more embodiments, the second target oscillation value may be calculated using the following method, which may be carried out by the apparatus 100, including the sensor and control system 200. The controller 190 may receive data, process and track the data, and perform various calculations to determine the trapped torque in the apparatus 100. In one or more embodiments, the method may begin while making a new connection with respect to the drill string. The new connection may include disconnecting the top drive from the drill string, introducing a new pipe stand to the drill string and making up the connection, and then driving the new stand with the top drive. With the bit still off the bottom of the borehole from making up the connection, the top drive begins to rotate the drill string. The sensor and control system 200 monitors the torque and the RPM of the top drive from the startup time to the peak time, as described above. In some embodiments, monitoring the RPM may be accomplished by the position sensor 234 or other sensor of the top drive 140. Monitoring the torque may be accomplished using the torque sensors about the apparatus 100. The nonstop transition module 253 monitors the torque trajectory to recognize the peak torque and to assign the peak location as the peak time. It may then continue to monitor the torque for the moment in time when the torque trajectory changes from its decreasing trajectory toward a steady state trajectory indicative of a steady state condition. The nonstop transition module 253 may calculate the trapped torque as a function of degrees of rotation. In some implementations, this may be done by taking the integral of the RPM curve between the startup time to the peak time to determine the area under the curve. This calculated value may represent the trapped torque in the drilling system as a function of degrees of rotation, and may be plotted. Using this calculation method, the trapped torque may be represented by a rotational amount or measurement. For example, the nonstop transition module 253 may integrate the area under the RPM graph to determine rotational displacement, which may be expressed in degrees or other units. Using 360° or equivalent units per rotation, the nonstop transition module 253 may determine the number of revolutions of trapped torque in the drill string. In some embodiments, these calculations may be performed in real-time based on the real-time detected torque.

Figure 6:
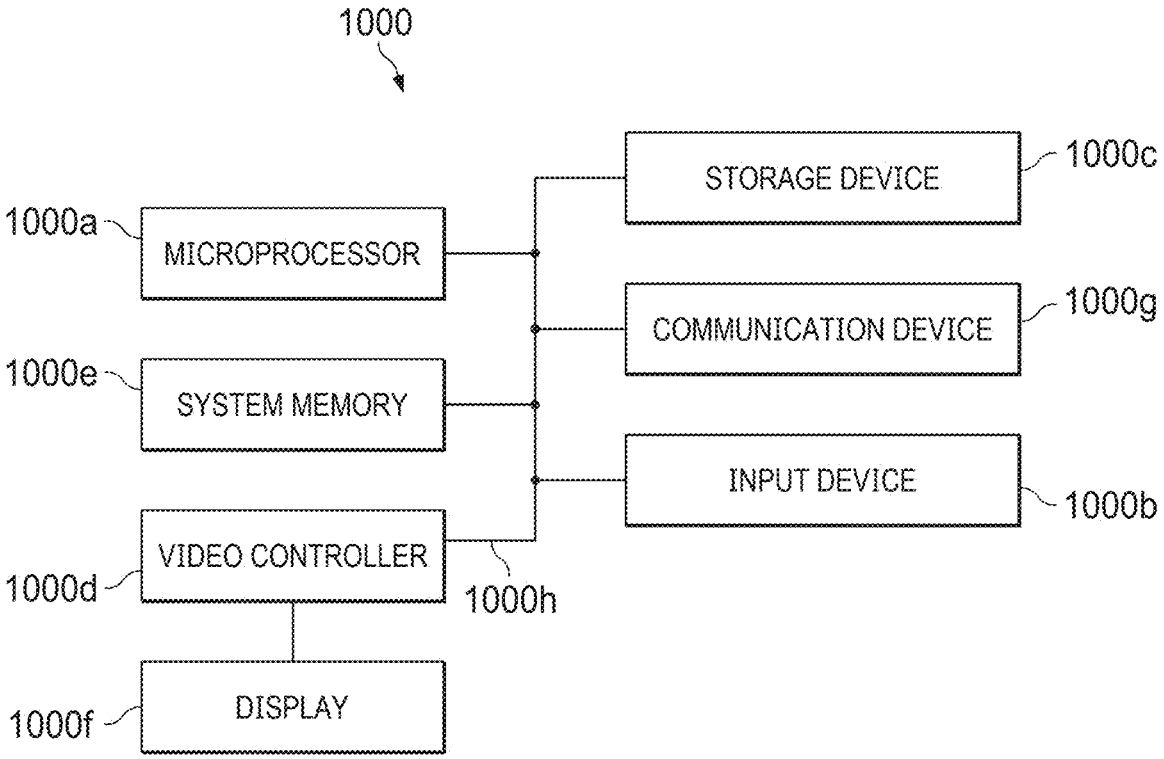
FIG. 6 illustrates a node for implementing one or more embodiments of the present disclosure, according to one or more embodiments of the present disclosure.

FIG. 6 is a diagrammatic illustration of a node for implementing one or more example embodiments of the present disclosure, according to one or more aspects of the present disclosure.

In an example embodiment, as illustrated in FIG. 6 with continuing reference to FIGS. 1, 2, 3A, 3B, 3C, 4, and 5, an illustrative node 1000 for implementing one or more of the example embodiments described above and/or illustrated in FIGS. 1, 2, 3A, 3B, 3C, 4, and 5 is depicted. The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In several example embodiments, the storage device 1000*c* may include a floppy drive, hard drive, CD-ROM, optical drive, any other form of storage device and/or any combination thereof. In several example embodiments, the storage device 1000*c* may include, and/or be capable of receiving, a floppy disk, CD-ROM, DVD-ROM, or any other form of computer-readable medium that may contain executable instructions. In several example embodiments, the communication device 1000*g* may include a modem, network card, or any other device to enable the node to communicate with other nodes. In several example embodiments, any node represents a plurality of interconnected (whether by intranet or Internet) computer systems, including without limitation, personal computers, mainframes, PDAs, smartphones and cell phones.

In several example embodiments, one or more of the components of the systems described above and/or illustrated in FIGS. 1, 2, 3A, 3B, 3C, 4, and 5 include at least the node 1000 and/or components thereof, and/or one or more nodes that are substantially similar to the node 1000 and/or components thereof. In several example embodiments, one or more of the above-described components of the node 1000, the apparatus 100, and/or the example embodiments described above and/or illustrated in FIGS. 1, 2, 3A, 3B, 3C, 4, and 5 include respective pluralities of same components.

In several example embodiments, one or more of the applications, systems, and application programs described above and/or illustrated in FIGS. 1, 2, 3A, 3B, 3C, 4, and 5 include a computer program that includes a plurality of instructions, data, and/or any combination thereof; an application written in, for example, Arena, HyperText Markup Language (HTML), Cascading Style Sheets (CSS), JavaScript, Extensible Markup Language (XML), asynchronous JavaScript and XML (Ajax), and/or any combination thereof; a web-based application written in, for example, Java or Adobe Flex, which in several example embodiments pulls real-time information from one or more servers, automatically refreshing with latest information at a predetermined time increment; or any combination thereof. The one or more server(s), in some embodiments may be remote (e.g., remote from apparatus 100) and accessible by a cloud or other network described herein. In other embodiments, the one or more server(s) are described as one or more edge server(s) and are located on a portion of apparatus 100.

In several example embodiments, a computer system typically includes at least hardware capable of executing machine readable instructions, as well as the software for executing acts (typically machine-readable instructions) that produce a desired result. In several example embodiments, a computer system may include hybrids of hardware and software, as well as computer sub-systems.

In several example embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several example embodiments, hardware may include any physical device that is capable of storing machine-readable instructions, such as memory or other data storage devices. In several example embodiments, other forms of hardware include hardware sub-systems, including transfer devices such as modems, modem cards, ports, and port cards, for example.

In several example embodiments, software includes any machine code stored in any memory medium, such as RAM or ROM, and machine code stored on other devices (such as floppy disks, flash memory, or a CD ROM, for example). In several example embodiments, software may include source or object code. In several example embodiments, software encompasses any set of instructions capable of being executed on a node such as, for example, on a client machine or server. In some embodiments, software includes one or more software modules including code, programming object, programming structure, or combinations thereof. In one or more embodiments, the one or more software modules comprise, by way of nonlimiting examples, a web application, a mobile application, and a standalone application. In various embodiments, software modules are in more than one computer program or application. In some embodiments, the software modules are hosted by more than one machine. In some embodiments, the software modules are hosted by more than one machine in more than one location.

In several example embodiments, combinations of software and hardware could also be used for providing enhanced functionality and performance for certain embodiments of the present disclosure. In an example embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several example embodiments, computer readable mediums include, for example, passive data storage, such as a random-access memory (RAM) as well as semi-permanent data storage such as a compact disk read only memory (CD-ROM). One or more example embodiments of the present disclosure may be embodied in the RAM of a computer to transform a standard computer into a new specific computing machine. In several example embodiments, data structures are defined organizations of data that may enable an embodiment of the present disclosure. In an example embodiment, a data structure may provide an organization of data, or an organization of executable code.

In several example embodiments, any networks and/or one or more portions thereof may be designed to work on any specific architecture. In an example embodiment, one or more portions of any networks may be executed on a single computer, local area networks, client-server networks, wide area networks, internets, hand-held and other portable and wireless devices and networks.

In several example embodiments, a database may be any standard or proprietary database software. In several example embodiments, the database may have fields, records, data, and other database elements that may be associated through database specific software. In several example embodiments, data may be mapped. In several example embodiments, mapping is the process of associating one data entry with another data entry. In an example embodiment, the data contained in the location of a character file can be mapped to a field in a second table. In several example embodiments, the physical location of the database is not limiting, and the database may be distributed. In an example embodiment, the database may exist remotely from the server, and run on a separate platform. In an example embodiment, the database may be accessible across the Internet. In several example embodiments, more than one database may be implemented.

In several example embodiments, a plurality of instructions stored on a computer readable medium may be executed by one or more processors to cause the one or more processors to carry out or implement in whole or in part the above-described operation of each of the above-described example embodiments of the system, the method, and/or any combination thereof. In several example embodiments, such a processor may include one or more of the microprocessor 1000*a*, any processor(s) that are part of the components of the system, and/or any combination thereof, and such a computer readable medium may be distributed among one or more components of the system. In several example embodiments, such a processor may execute the plurality of instructions in connection with a virtual computer system. In several example embodiments, such a plurality of instructions may communicate directly with the one or more processors, and/or may interact with one or more operating systems, middleware, firmware, other applications, and/or any combination thereof, to cause the one or more processors to execute the instructions.

In several example embodiments, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several example embodiments, while different steps, processes, and procedures are described as appearing as distinct acts, one or more of the steps, one or more of the processes, and/or one or more of the procedures may also be performed in different orders, simultaneously, and/or sequentially. In several example embodiments, the steps, processes and/or procedures may be merged into one or more steps, processes, and/or procedures, and unless specified otherwise, may also occur in a different order.

In several example embodiments, one or more of the operational steps in each embodiment may be omitted. Moreover, in some embodiments, some features of the present disclosure may be employed without a corresponding use of the other features. Moreover, one or more of the above-described embodiments and/or variations may be combined in whole or in part with any one or more of the other above-described embodiments and/or variations and this is within the contemplated scope of disclosure herein, unless stated otherwise.

The phrase "at least one of A and B" should be understood to mean "A, B, or both A and B." The phrases "one or more of the following: A, B, and C" and "one or more of A, B, and C" should each be understood to mean "A; B; C; A and B; B and C; A and C; or all three of A, B, and C."

The present disclosure provides a drilling method, including rotary drilling, using a control system, a first segment of a wellbore by rotating a bottom hole assembly (BHA) on a drill string driven by a top drive; stopping, using the control system, the rotary drilling of the first segment of the wellbore; collecting, using a first sensor associated with the top drive and after the rotary drilling of the first segment of the wellbore has been stopped, first data associated with a reverse rotation of at least a portion of the drill string; calculating, using the control system and the first data associated with the reverse rotation of the at least a portion of the drill string, a first rotational displacement associated with the drill string; and determining, using the control system and based on the calculated first rotational displacement associated with the drill string, a first target oscillation revolution amount for the drill string; wherein the top drive is configured to oscillate the drill string during slide drilling, using the control system and based on the first target oscillation revolution amount, to reduce friction between the drill string and the wellbore without changing a toolface orientation of the BHA. In one or more embodiments, the first rotational displacement is introduced into the drill string due to the rotation of the drill string driven by the top drive and due to friction between the drill string and the wellbore; the introduction of the first rotational displacement into the drill string results in a trapped torque being stored in the drill string; stopping the rotary drilling of the first segment of the wellbore enables the trapped torque to be released; and the reverse rotation of the at least a portion of the drill string is associated with a release of the trapped torqued stored in the drill string. In one or more embodiments, the drilling method further includes releasing, as a result of stopping the rotary drilling of the first segment of the wellbore, the trapped torque stored in the drill string. In one or more embodiments, the drilling method further includes transmitting, using the control system and prior to stopping the rotary drilling of the first segment of the wellbore, a command to a controller of the top drive to stop the rotation of the drill string driven by the top drive. In one or more embodiments, the first rotational displacement and the first target oscillation revolution amount are associated with a number of wraps that can be introduced into the drill string during slide drilling without changing a toolface orientation of the BHA. In one or more embodiments, the first sensor associated with the top drive is a position sensor or a rotational speed sensor; and the first data includes a rotational speed associated with the reverse rotation of the drill string. In one or more embodiments, the drilling method further includes slide drilling, using the control system, a second segment of the wellbore; and oscillating, using the control system and the top drive, and based on the first target oscillation revolution amount, the drill string while slide drilling the second segment of the wellbore. In one or more embodiments, the drilling method further includes collecting, using a second sensor associated with the top drive and during a startup process of rotary drilling a second segment of the wellbore, second data associated with an applied torque that is applied to the drill string by the top drive; calculating, using the control system and the second data associated with the applied torque that is applied to the drill string by the top drive, a second rotational displacement introduced into the drill string during the startup process of rotary drilling the second segment of the wellbore; and determining, using the control system and based on the calculated second rotational displacement, a second target oscillation revolution amount for oscillating the drill string during slide drilling. In one or more embodiments, the first target oscillation revolution amount defines a minimum value of a target oscillation revolution range; and wherein the second target oscillation revolution amount defines a maximum value of the target oscillation revolution range. In one or more embodiments, the drilling method further includes slide drilling, using the control system, a third segment of the wellbore; and oscillating, using the control system and the top drive, the drill string within the target oscillation revolution range while slide drilling the third segment of the wellbore.

The present disclosure further provides a drilling apparatus, including a top drive; a first sensor associated with the top drive; a drill string operably connected to the top drive; a bottom hole assembly (BHA) operably connected to the drill string; and a non-transitory computer readable medium having stored thereon a plurality of instructions, wherein the instructions are executed with one or more processors so that the following steps are executed: rotary drilling a first segment of a wellbore by rotating the BHA on the drill string driven by the top drive; stopping the rotary drilling of the first segment of the wellbore; collecting, using the first sensor associated with the top drive and after the rotary drilling of the first segment of the wellbore has been stopped, first data associated with a reverse rotation of at least a portion of the drill string; calculating, using the first data associated with the reverse rotation of the at least a portion of the drill string, a first rotational displacement associated with the drill string; and determining, based on the calculated first rotational displacement associated with the drill string, a first target oscillation revolution amount for the drill string; wherein the top drive is configured to oscillate the drill string during slide drilling, based on the first target oscillation revolution amount, to reduce friction between the drill string and the wellbore without changing a toolface orientation of the BHA. In one or more embodiments, the first rotational displacement is introduced into the drill string due to the rotation of the drill string driven by the top drive and due to friction between the drill string and the wellbore; the introduction of the first rotational displacement into the drill string results in a trapped torque being stored in the drill string; stopping the rotary drilling of the first segment of the wellbore enables the trapped torque to be released; and the reverse rotation of the at least a portion of the drill string is associated with a release of the trapped torqued stored in the drill string. In one or more embodiments, the instructions are executed with the one or more processors so that the following additional step is executed: releasing, as a result of stopping the rotary drilling of the first segment of the wellbore, the trapped torque stored in the drill string. In one or more embodiments, freeing at least one end of the drill string includes stopping the rotation of the drill string driven by the top drive. In one or more embodiments, the drilling apparatus further includes a controller associated with the top drive; wherein the instructions are executed with the one or more processors so that the following additional step is executed: transmitting, prior to stopping the rotary drilling of the first segment of the wellbore, a command to a controller of the top drive to stop the rotation of the drill string driven by the top drive. In one or more embodiments, the first rotational displacement and the first target oscillation revolution amount are associated with a number of wraps that can be introduced into the drill string during slide drilling without changing a toolface orientation of the BHA. In one or more embodiments, the first sensor associated with the top drive is a position sensor or a rotational speed sensor; and the first data includes a rotational speed associated with the reverse rotation of the drill string. In one or more embodiments, the instructions are executed with the one or more processors so that the following additional step is executed: slide drilling a second segment of the wellbore; and oscillating, using the top drive, and based on the first target oscillation revolution amount, the drill string while slide drilling the second segment of the wellbore. In one or more embodiments, the drilling apparatus further includes a second sensor; wherein the instructions are executed with the one or more processors so that the following additional step is executed: collecting, using a second sensor associated with the top drive and during a startup process of rotary drilling a second segment of the wellbore, second data associated with an applied torque that is applied to the drill string by the top drive; calculating, using the second data associated with the applied torque that is applied to the drill string by the top drive, a second rotational displacement introduced into the drill string during the startup process of rotary drilling the second segment of the wellbore; and determining, based on the calculated second rotational displacement, a second target oscillation revolution amount for oscillating the drill string during slide drilling. In one or more embodiments, the first target oscillation revolution amount defines a minimum value of a target oscillation revolution range; the second target oscillation revolution amount defines a maximum value of the target oscillation revolution range; and the instructions are executed with the one or more processors so that the following additional step is executed: slide drilling a third segment of the wellbore; and oscillating, using the top drive, the drill string within the target oscillation revolution range while slide drilling the third segment of the wellbore.

It is understood that variations may be made in the foregoing without departing from the scope of the present disclosure.

In several embodiments, one or more of the operational steps in each embodiment may be omitted. Moreover, in some embodiments, some features of the present disclosure may be employed without a corresponding use of the other features. Moreover, one or more of the embodiments disclosed above, or variations thereof, may be combined in whole or in part with any one or more of the other embodiments described above, or variations thereof.

Although several embodiments have been described in detail above, the embodiments described are illustrative only and are not limiting, and those of ordinary skill in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A drilling method, comprising:

rotary drilling, using a control system, a first segment of a wellbore by rotating a bottom hole assembly (BHA) on a drill string driven by a top drive;

stopping, using the control system, the rotary drilling of the first segment of the wellbore;

collecting, using a first sensor associated with the top drive and after the rotary drilling of the first segment of the wellbore has been stopped, first data associated with a free reverse rotation of at least a portion of the drill string;

calculating, using the control system and the first data associated with the free reverse rotation of the at least a portion of the drill string, a first rotational displacement associated with the drill string;

determining, using the control system and based on the calculated first rotational displacement associated with the drill string, a first target oscillation revolution amount for the drill string;

slide drilling, using the control system, a second segment of the wellbore; and oscillating, using the control system, the top drive, and the first target oscillation revolution amount, the drill string while slide drilling the second segment of the wellbore to reduce friction between the drill string and the wellbore without changing a toolface orientation of the BHA.

2. The drilling method of claim 1, wherein the first rotational displacement is introduced into the drill string during the rotary drilling of the first segment of the wellbore due to the rotation of the drill string driven by the top drive and due to friction between the drill string and the wellbore;

wherein the introduction of the first rotational displacement into the drill string results in a trapped torque being stored in the drill string;

wherein stopping the rotary drilling of the first segment of the wellbore enables the trapped torque to be released; and wherein the free reverse rotation of the at least a portion of the drill string is associated with a release of the trapped torqued stored in the drill string.

3. The drilling method of claim 2, further comprising:

releasing, as a result of stopping the rotary drilling of the first segment of the wellbore, the trapped torque stored in the drill string.

4. The drilling method of claim 1, further comprising:

transmitting, using the control system and prior to stopping the rotary drilling of the first segment of the wellbore, a command to a controller of the top drive to stop the rotation of the drill string driven by the top drive.

5. The drilling method of claim 1, wherein the first rotational displacement and the first target oscillation revolution amount are associated with a number of wraps that can be introduced into the drill string during the slide drilling of the second segment of the wellbore without changing a toolface orientation of the BHA.

6. The drilling method of claim 1, wherein the first sensor associated with the top drive is a position sensor or a rotational speed sensor; and wherein the first data includes a rotational speed associated with the free reverse rotation of the drill string.

7. The drilling method of claim 1, further comprising:

collecting, using a second sensor associated with the top drive and during a startup process of rotary drilling a third segment of the wellbore, second data associated with an applied torque that is applied to the drill string by the top drive;

calculating, using the control system and the second data associated with the applied torque that is applied to the drill string by the top drive, a second rotational displacement introduced into the drill string during the startup process of rotary drilling the third segment of the wellbore; and determining, using the control system and based on the calculated second rotational displacement, a second target oscillation revolution amount for the drill string.

8. The drilling method of claim 7, wherein the first target oscillation revolution amount defines a minimum value of a target oscillation revolution range; and wherein the second target oscillation revolution amount defines a maximum value of the target oscillation revolution range.

9. The drilling method of claim 8, further comprising:

slide drilling, using the control system, a fourth segment of the wellbore; and oscillating, using the control system and the top drive, the drill string within the target oscillation revolution range while slide drilling the fourth segment of the wellbore.

10. The drilling method of claim 1, further comprising:

collecting, using a second sensor associated with the top drive and during a startup process of the rotary drilling of the first segment of the wellbore, second data associated with an applied torque that is applied to the drill string by the top drive;

calculating, using the control system and the second data associated with the applied torque that is applied to the drill string by the top drive, a second rotational displacement introduced into the drill string during the startup process of the rotary drilling of the first segment of the wellbore;

determining, using the control system and based on the calculated second rotational displacement, a second target oscillation revolution amount for the drill string;

wherein the first target oscillation revolution amount defines a minimum value of a target oscillation revolution range; and wherein the second target oscillation revolution amount defines a maximum value of the target oscillation revolution range; and oscillating, using the control system and the top drive, the drill string within the target oscillation revolution range during the slide drilling of the second segment of the wellbore.

11. The drilling method of claim 1, further comprising:

stopping, using the control system, a lowering of the BHA and the drill string into the wellbore so that the BHA becomes positioned off a bottom of the wellbore;

wherein the first data associated with the free reverse rotation of the at least a portion of the drill string is collected while the BHA is off the bottom of the wellbore.

12. The drilling method of claim 1, wherein the first rotational displacement is introduced into the drill string before the BHA is on a bottom of the wellbore due to the rotation of the drill string driven by the top drive and due to the friction between the drill string and the wellbore.

13. A drilling apparatus, comprising:

a top drive;

a first sensor associated with the top drive;

a drill string operably connected to the top drive;

a bottom hole assembly (BHA) operably connected to the drill string; and a non-transitory computer readable medium having stored thereon a plurality of instructions, wherein the instructions are executed with one or more processors so that the following steps are executed:

rotary drilling a first segment of a wellbore by rotating the BHA on the drill string driven by the top drive;

stopping the rotary drilling of the first segment of the wellbore;

collecting, using the first sensor associated with the top drive and after the rotary drilling of the first segment of the wellbore has been stopped, first data associated with a free reverse rotation of at least a portion of the drill string;

calculating, using the first data associated with the free reverse rotation of the at least a portion of the drill string, a first rotational displacement associated with the drill string;

determining, based on the calculated first rotational displacement associated with the drill string, a first target oscillation revolution amount for the drill string;

slide drilling, using the control system, a second segment of the wellbore; and oscillating, using the control system, the top drive, and the first target oscillation revolution amount, the drill string while slide drilling the second segment of the wellbore, to reduce friction between the drill string and the wellbore without changing a toolface orientation of the BHA.

14. The drilling apparatus of claim 13, wherein the first rotational displacement is introduced into the drill string due to the rotation of the drill string driven by the top drive and due to friction between the drill string and the wellbore;

wherein the introduction of the first rotational displacement into the drill string results in a trapped torque being stored in the drill string;

wherein stopping the rotary drilling of the first segment of the wellbore enables the trapped torque to be released; and wherein the free reverse rotation of the at least a portion of the drill string is associated with a release of the trapped torqued stored in the drill string.

15. The drilling apparatus of claim 14, wherein the instructions are executed with the one or more processors so that the following additional step is executed:

releasing, as a result of stopping the rotary drilling of the first segment of the wellbore, the trapped torque stored in the drill string.

16. The drilling apparatus of claim 15, wherein stopping the rotary drilling of the first segment of the wellbore comprises disengaging a rotational force between the top drive and the drill string so that at least one end of the drill string becomes rotationally free; and wherein the at least one end of the drill string being rotationally free enables the free reverse rotation of the at least a portion of the drill string.

17. The drilling apparatus of claim 13, further comprising:

a controller associated with the top drive;

wherein the instructions are executed with the one or more processors so that the following additional step is executed:

transmitting, prior to stopping the rotary drilling of the first segment of the wellbore, a command to the controller associated with the top drive to stop the rotation of the drill string driven by the top drive.

18. The drilling apparatus of claim 13, wherein the first rotational displacement and the first target oscillation revolution amount are associated with a number of wraps that can be introduced into the drill string during the slide drilling of the second segment of the wellbore without changing a toolface orientation of the BHA.

19. The drilling apparatus of claim 13, wherein the first sensor associated with the top drive is a position sensor or a rotational speed sensor; and wherein the first data includes a rotational speed associated with the free reverse rotation of the drill string.

20. The drilling apparatus of claim 13, further comprising:

a second sensor;

wherein the instructions are executed with the one or more processors so that the following additional step is executed:

collecting, using a second sensor associated with the top drive and during a startup process of rotary drilling a third segment of the wellbore, second data associated with an applied torque that is applied to the drill string by the top drive;

calculating, using the second data associated with the applied torque that is applied to the drill string by the top drive, a second rotational displacement introduced into the drill string during the startup process of rotary drilling the third segment of the wellbore; and determining, based on the calculated second rotational displacement, a second target oscillation revolution amount for the drill string.

21. The drilling apparatus of claim 20, wherein the first target oscillation revolution amount defines a minimum value of a target oscillation revolution range;

wherein the second target oscillation revolution amount defines a maximum value of the target oscillation revolution range; and wherein the instructions are executed with the one or more processors so that the following additional step is executed:

slide drilling a fourth segment of the wellbore; and oscillating, using the top drive, the drill string within the target oscillation revolution range while slide drilling the fourth segment of the wellbore.

22. The drilling apparatus of claim 13, further comprising:

wherein the instructions are executed with the one or more processors so that the following additional steps are executed:

collecting, using a second sensor associated with the top drive and during a startup process of the rotary drilling of the first segment of the wellbore, second data associated with an applied torque that is applied to the drill string by the top drive;

calculating, using the control system and the second data associated with the applied torque that is applied to the drill string by the top drive, a second rotational displacement introduced into the drill string during the startup process of the rotary drilling of the first segment of the wellbore;

determining, using the control system and based on the calculated second rotational displacement, a second target oscillation revolution amount for the drill string;

wherein the first target oscillation revolution amount defines a minimum value of a target oscillation revolution range; and wherein the second target oscillation revolution amount defines a maximum value of the target oscillation revolution range; and oscillating, using the control system and the top drive, the drill string within the target oscillation revolution range during the slide drilling of the second segment of the wellbore.

* * * * *